US012584674B2

(12) United States Patent
Jeong et al.

(10) Patent No.: US 12,584,674 B2
(45) Date of Patent: Mar. 24, 2026

(54) REFRIGERATOR AND CONTROLLING METHOD FOR SAME

(71) Applicant: SAMSUNG ELECTRONICS CO., LTD., Suwon-si (KR)

(72) Inventors: Jin Jeong, Suwon-si (KR); Sunggu Kang, Suwon-si (KR); Bongsu Son, Suwon-si (KR); Yongsun Song, Suwon-si (KR); Kwanyeol Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 136 days.

(21) Appl. No.: 18/668,576

(22) Filed: May 20, 2024

(65) Prior Publication Data

US 2024/0310103 A1 Sep. 19, 2024

Related U.S. Application Data

(63) Continuation of application No. PCT/KR2023/000498, filed on Jan. 11, 2023.

(30) Foreign Application Priority Data

Feb. 10, 2022 (KR) ..... 10-2022-0017803
Aug. 31, 2022 (KR) ..... 10-2022-0110358

(51) Int. Cl.
*F25C 1/00* (2006.01)
*F25C 1/24* (2018.01)
(Continued)

(52) U.S. Cl.
CPC ..... *F25C 1/25* (2018.01); *F25C 1/24* (2013.01); *F25C 5/08* (2013.01); *F25C 2600/00* (2013.01)

(58) Field of Classification Search
CPC ..... F25C 1/24; F25C 1/25; F25C 5/08; F25C 2600/00; F25C 2600/04; F25C 2700/12
See application file for complete search history.

(56) References Cited

U.S. PATENT DOCUMENTS 4,774,814 A 10/1988 Yingst et al.
5,477,694 A 12/1995 Black et al.
(Continued)

FOREIGN PATENT DOCUMENTS

CN 111829226 A 10/2020
EP 3 862 663 A1 8/2021
(Continued)

OTHER PUBLICATIONS

KR 2008 0108187 (English translation) (Year: 2008).*
(Continued)

*Primary Examiner* — Jonathan Bradford
(74) *Attorney, Agent, or Firm* — STAAS & HALSEY LLP

(57) ABSTRACT

A refrigerator including: a main body including at least one storage compartment; a temperature sensor arrangeable in the main body; an ice making device including an ice tray arrangeable in the at least one storage compartment such that while the ice tray is arranged in the storage compartment, the ice tray allows ice to be formed therein, and an ice separator configured to separate the ice formed from the ice tray; a cooling device configured to cool the at least one storage compartment; a water supply device configured to supply water to the ice tray that forms the ice; and a controller configured to, based on a temperature value detected by the temperature sensor arranged in the main body being greater than a preset value, control the water supply device so that
(Continued)

no water is supplied to the ice tray and control the ice making device to perform an inspection cycle to inspect the ice separator.

15 Claims, 14 Drawing Sheets

(51) Int. Cl.
*F25C 1/25* (2018.01)
*F25C 5/08* (2006.01)

(56) References Cited

U.S. PATENT DOCUMENTS

| | | | |
|---|---|---|---|
| 6,148,620 | A | 11/2000 | Kumagai et al. |
| 7,752,859 | B2 | 7/2010 | Lee et al. |
| 10,054,358 | B2 | 8/2018 | Park et al. |
| 2021/0348824 | A1 | 11/2021 | Lee et al. |
| 2021/0356189 | A1 | 11/2021 | Bae et al. |
| 2024/0093928 | A1 | 3/2024 | Lee et al. |

FOREIGN PATENT DOCUMENTS

| | | |
|---|---|---|
| JP | 288395 | 4/1999 |
| JP | 5329385 | 8/2013 |
| JP | 2013-181734 | 9/2013 |
| JP | 5858678 | 2/2016 |
| KR | 2003-0015053 | 2/2003 |
| KR | 10-0786075 | 12/2007 |
| KR | 10-2008-0108187 | 12/2008 |
| KR | 10-2011-0072690 | 6/2011 |
| KR | 10-1483028 | 1/2015 |
| KR | 10-1652585 | 8/2016 |
| KR | 10-1655802 | 9/2016 |
| KR | 10-2021-0005477 | 1/2021 |
| KR | 10-2021-0005498 | 1/2021 |
| KR | 10-2021-0098201 | 8/2021 |

OTHER PUBLICATIONS

Extended European Search Report issued Feb. 19, 2025 for Application No. 23753003.5.
International Search Report dated Apr. 28, 2023 issued in PCT Application No. PCT/KR2023/000498
Written Opinion dated Apr. 28, 2023 issued in PCT Application No. PCT/KR2023/000498.

* cited by examiner

FIG. 10

| FIRST HEATING PROCESS | INSPECTION MODE | |
|---|---|---|
| | OPERATING TIME (m) | DUTY (%) |
| FIRST STAGE | t0 | 0 |
| SECOND STAGE | 0 | 0 |
| THIRD STAGE | 0 | 0 |
| FOURTH STAGE | 0 | 0 |
| FIFTH STAGE | 0 | 0 |
| SIXTH STAGE | 0 | 0 |
| SEVENTH STAGE | 0 | 0 |
| ⋮ | ⋮ | ⋮ |

FIG. 11

| FIRST HEATING PROCESS | FIRST ICE MAKING MODE | | SECOND ICE MAKING MODE | | THIRD ICE MAKING MODE | | ··· |
|---|---|---|---|---|---|---|---|
| | OPERATING TIME (m) | DUTY (%) | OPERATING TIME (m) | DUTY (%) | OPERATING TIME (m) | DUTY (%) | ··· |
| FIRST STAGE | t11 | d11 | t21 | d21 | t31 | d31 | ··· |
| SECOND STAGE | t12 | d12 | t22 | d22 | t32 | d32 | ··· |
| THIRD STAGE | t13 | d13 | t23 | d23 | t33 | d33 | ··· |
| FOURTH STAGE | t14 | d14 | t24 | d24 | t34 | d34 | ··· |
| FIFTH STAGE | t15 | d15 | t25 | d25 | t35 | d35 | ··· |
| SIXTH STAGE | t16 | d16 | t26 | d26 | t36 | d36 | ··· |
| SEVENTH STAGE | t17 | d17 | t27 | d27 | t37 | d37 | ··· |
| ⋮ | ⋮ | ⋮ | ⋮ | ⋮ | ⋮ | ⋮ | ··· |

REFRIGERATOR AND CONTROLLING METHOD FOR SAME

CROSS-REFERENCE TO RELATED APPLICATION

This application is a continuation application, under 35 U.S.C. § 111(a), of international application No. PCT/KR2023/000498, filed on Jan. 11, 2023, which claims priority under 35 U. S. C. § 119 to Korean Patent Application Nos. 10-2022-0017803, filed Feb. 10, 2022, and 10-2022-0110358, filed Aug. 31, 2022, the disclosures of which are incorporated herein by reference in their entireties.

FIELD BACKGROUND

The disclosure relates to a refrigerator equipped with an ice making device, and a method for controlling the refrigerator.

DESCRIPTION OF RELATED ART

In general, a refrigerator is a device that cools and stores food using a refrigeration cycle, and includes a compressor, a condenser, an expansion valve, and an evaporator. A refrigerator may be equipped with an ice making device inside.

In existing refrigerators, a user is required to supply water to the ice maker directly. However, recently developed refrigerators are equipped with a water supply device for automatically supplying water to the ice making device.

In addition, due to users' needs for the shape and quality of ice, refrigerators include an ice making device to produce different types of ice.

In particular, recently, users' demand for spherical ice has been increasing, but spherical ice takes some time to make.

SUMMARY

According to an aspect of the disclosure, a refrigerator may include: a main body including at least one storage compartment; a temperature sensor arrangeable in the main body; an ice making device including an ice tray arrangeable in the at least one storage compartment such that while the ice tray is arranged in the storage compartment, the ice tray allows ice to be produced therein, and an ice separator configured to separate ice formed from the ice tray from the ice tray; a cooling device configured to cool the at least one storage compartment; a water supply device configured to supply water to the ice tray that produces the ice; and a controller configured to, based on a temperature value detected by the temperature sensor arranged in the main body being greater than a preset value, control the water supply device so that no water is supplied to the ice tray and control the ice making device to perform an inspection cycle to inspect the ice separator.

In addition, the controller may be configured to, based on completion of the inspection cycle, control the water supply device to supply water to the ice tray, and control the ice making device to perform a default ice making cycle to produce ice.

In addition, the ice making device further comprises a heating device configured to heat water stored in the ice tray, and wherein a total operating time of the heating device in the default ice making cycle may be more than a first time period, and a total operating time of the heating device in the inspection cycle may be a second time period shorter than the first time period.

In addition, an initial operation timing of the heating device in the inspection cycle may precede an initial operation timing of the ice separator by a first preset time period, an initial operation timing of the heating device in the default ice making cycle may precede an initial operation timing of the ice separator by a second preset time period, and the first preset time period may be shorter than the second preset time period.

In addition, the ice making device further comprises a heating device configured to heat water stored in the ice tray, and where the controller may be configured to operate the ice separator in the inspection cycle without operating the heating device.

In addition, a default ice making mode corresponding to the default ice making cycle may be an ice making mode that takes a shortest time to produce a piece of ice among a plurality of ice making modes that a user may select.

In addition, the controller may be configured to, based on completion of the default ice making cycle, control the water supply device to supply water to the ice tray, and control the ice making device to perform a user-selected ice making cycle.

In addition, the controller may be configured to control the ice making device to perform the default ice making cycle instead of the user-selected ice making cycle, based on the default ice making cycle not being completed even though the temperature value detected by the temperature sensor may be less than the preset value.

In addition, the user-selected ice making cycle may be an ice making cycle according to an ice making mode selected by the user from the plurality of ice making modes.

In addition, the refrigerator may further include a display, and the controller may be configured to control the display to output a visual indication for notifying deterioration of ice quality based on completion of the default ice making cycle.

According to an aspect of the disclosure, a method for controlling a refrigerator may include controlling an ice making device that includes an ice tray that allows ice to be formed therein, and an ice separator configured to separate ice accommodated in the ice tray from the ice tray, the refrigerator may include a water supply device configured to supply water to the ice tray. The method may include: controlling, based on a temperature value detected by a temperature sensor arranged in a main body of the refrigerator being greater than a preset value, controlling the water supply device so that no water is supplied to the ice tray, and controlling the ice making device to perform an inspection cycle to inspect the ice separator.

In addition, the method may further include, based on completion of the inspection cycle, controlling the water supply device to supply water to the ice tray, and controlling the ice making device to perform a default ice making cycle.

In addition, a total operating time of the heating device in the default ice making cycle may be more than a first time period, and a total operating time of the heating device in the inspection cycle may be a second time period shorter than the first time period.

In addition, an initial operation timing of the heating device in the inspection cycle may precede an initial operation timing of the ice separator by a first preset time period, an initial operation timing of the heating device in the default ice making cycle may precede an initial operation timing of the ice separator by a second preset time period, and the first preset time period may be shorter than the second preset time period.

In addition, the controlling of the ice making device to perform the inspection cycle may include operating the ice separator without operating the heating device.

In addition, a default ice making mode corresponding to the default ice making cycle may be an ice making mode that takes a shortest time to produce a piece of ice among a plurality of ice making modes that a user may select.

In addition, the method may further include, based on completion of the default ice making cycle, controlling the water supply device to supply water to the ice tray, and controlling the ice making device to perform a user-selected ice making cycle according to an ice making mode selected by the user from the plurality of ice making modes.

In addition, the controlling of the ice making device to perform the default ice making cycle may include controlling the ice making device to perform the default ice making cycle instead of the user-selected ice making cycle, based on the default ice making cycle not being completed even though the temperature value detected by the temperature sensor may be less than the preset value.

In addition, the user-selected ice making cycle may be an ice making cycle according to an ice making mode selected by the user from the plurality of ice making modes.

In addition, the method may further include outputting a visual indication for notifying deterioration of ice quality based on completion of the default ice making cycle.

BRIEF DESCRIPTION OF DRAWINGS

FIG. 10 illustrates an example of a lookup table of a first heating process stage according to an inspection mode according to an embodiment.

FIG. 11 illustrates an example of a lookup table of a first heating process stage according to a plurality of ice making modes according to an embodiment.

DETAILED DESCRIPTION

Figure 1:
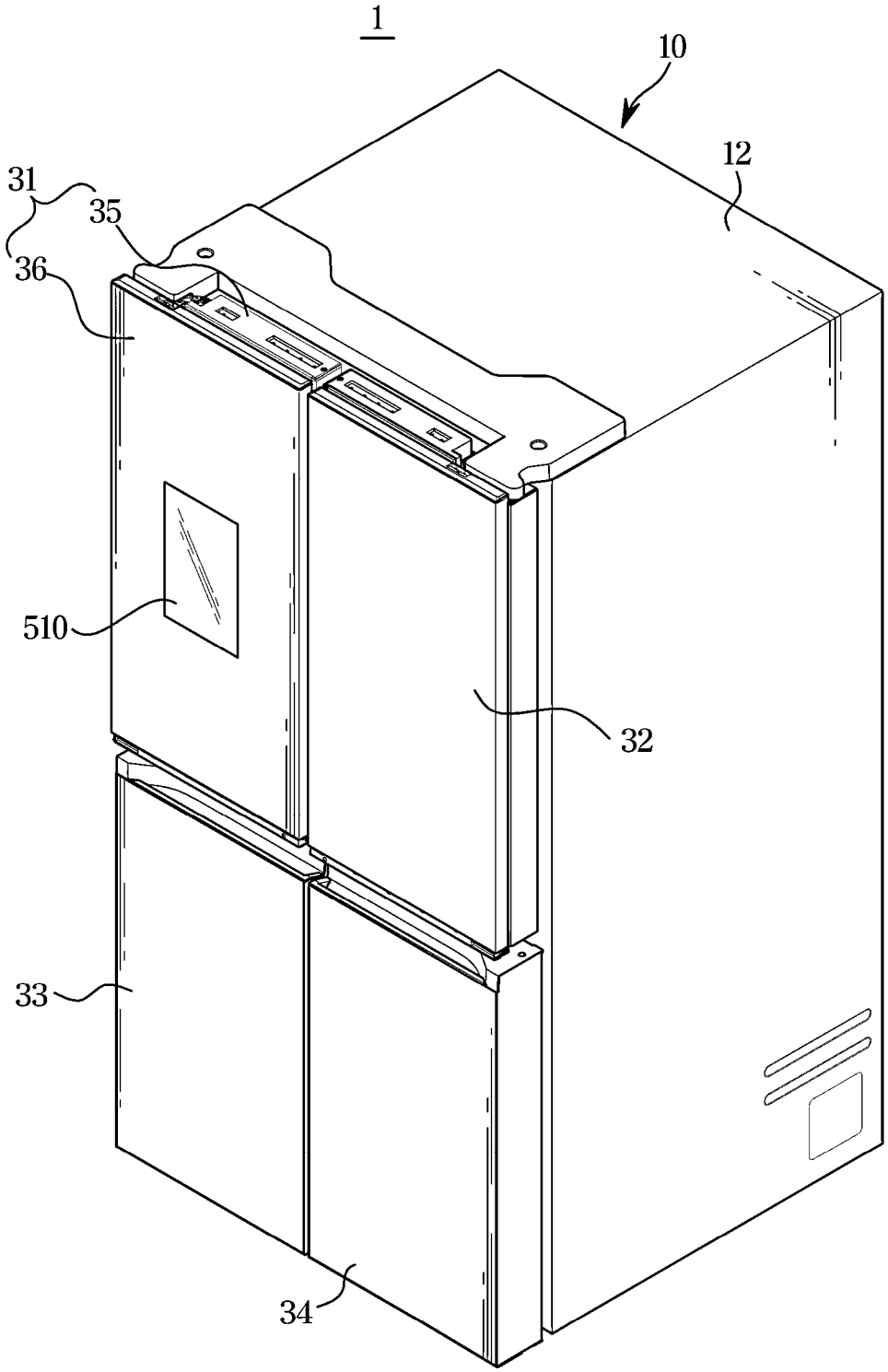
FIG. 1 is a perspective view of a refrigerator according to an embodiment.

Embodiments described in the disclosure and configurations shown in the drawings are merely examples of the embodiments of the disclosure, and may be modified in various different ways at the time of filing of the application to replace the embodiments and drawings of the disclosure.

The terms used herein are used only to describe particular embodiments and are not intended to limit the disclosure.

For example, it is to be understood that the singular forms are intended to include the plural forms as well, unless the context clearly dictates otherwise.

Also, it will be understood that the terms "include" and "have," are intended to indicate the presence of the features, numbers, steps, operations, components, parts, or combinations thereof disclosed in the disclosure, but do not preclude the presence or addition of one or more other elements.

Also, it will be understood that, although the terms including ordinal numbers, such as "first", "second", etc., may be used herein to describe various components, these components should not be limited by these terms.

Also, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Hereinafter, various embodiments of the disclosure are described in greater detail with reference to the accompanying drawings. Like reference numerals throughout the disclosure denote like elements.

An aspect of the disclosure is directed to providing a refrigerator and a method for controlling the refrigerator that may improve an ice making speed at a low storage compartment temperature.

According to an aspect of the disclosure, a refrigerator may improve an initial ice making speed after installation.

According to an aspect of the disclosure, consumer complaints due to ice not being made after the refrigerator is installed may be prevented.

Hereinafter, an operation principle and embodiments will be described in detail with reference to the accompanying drawings.

Figure 2:
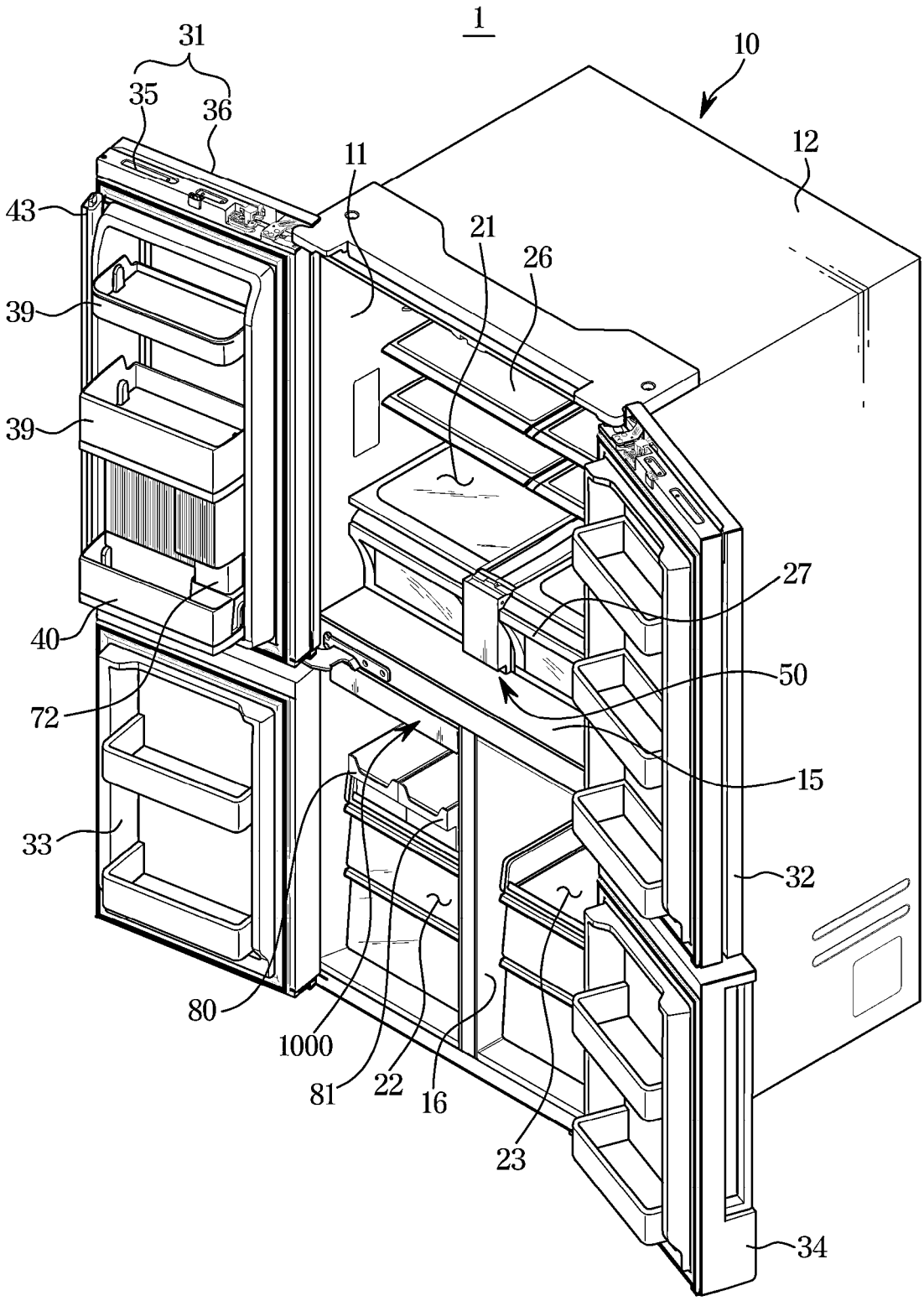
FIG. 2 is a view illustrating a state in which doors of the refrigerant of FIG. 1 are opened according to an embodiment.
Figure 3:
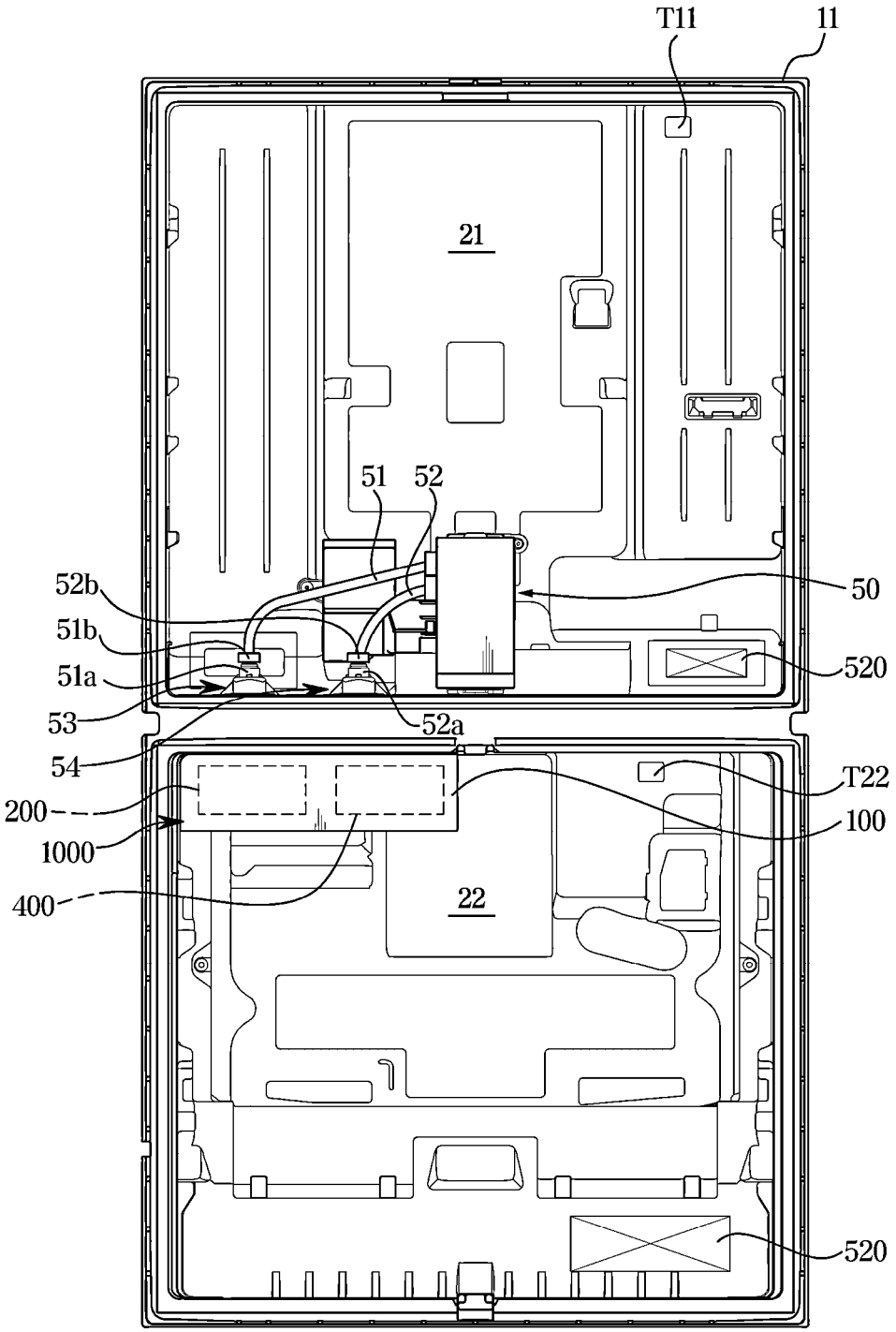
FIG. 3 is a schematic view illustrating a structure of an inner case, and a water supply device, an ice making unit, and a water supply passage arranged in the inner case of the refrigerant of FIG. 1 according to an embodiment.

FIG. 1 is a perspective view of a refrigerator according to an embodiment. FIG. 2 is a view illustrating a state in which doors of the refrigerant of FIG. 1 are opened. FIG. 3 is a schematic view illustrating a structure of an inner case, and a water supply device, an ice making unit, and a water supply passage arranged in the inner case of the refrigerant of FIG. 1.

Referring to FIG. 1 to FIG. 3, a refrigerator 1 according to an embodiment may include a main body 10, a plurality of storage compartments 21, 22, and 23 formed inside the main body 10, a plurality of doors 31, 32, 33, and 34 for opening and closing the plurality of storage compartments 21, 22, and 23, a user interface provided in at least one of the doors 31, 32, 33, or 34, and a cooling device 520 for supplying cold air to the plurality of storage compartments 21, 22 and 23.

The refrigerator 1 refers to a device that may store food at low temperatures. More specifically, the refrigerator 1 refers to a device that may maintain temperatures of the storage compartments 21, 22, and 23 below a desired level by repeating evaporation and compression of refrigerant to enable food to be stored at low temperatures.

The main body may include an inner case 11 forming the storage compartments, an outer case 12 coupled to an outside of the inner case 11 to form an exterior, and an insulating material (not shown) provided between the inner case 11 and the outer case 12 to insulate the storage compartments 21, 22, and 23.

The plurality of storage compartments 21, 22, and 23 may be divided into a plurality of spaces by a horizontal partition wall 15 and a vertical partition wall 16. The plurality of storage compartments 21, 22, and 23 may be divided into the first storage compartment 21, which is an upper storage compartment, and the second storage compartment 22 and the third storage compartment 23, which are lower storage compartments, by the horizontal partition wall 15. The lower storage compartment may be divided into the second storage compartment 22 and the third storage compartment 23 by the vertical partition wall 16.

The upper storage compartment, which is the first storage compartment 21, may be used as a refrigerating compartment. The lower storage compartments, which are the second storage compartment 22 and the third storage compartment 23, may be used as a freezing compartment. However, the division and use of the plurality of storage compartments 21, 22, and 23 as described above is only an example and is not limited thereto.

Hereinafter, the first storage compartment 21, which is the upper storage compartment, is referred to as a refrigerating compartment, and the second storage compartment 22 and the third storage compartment 23, which are the lower storage compartments, are referred to as a freezing compartment.

The refrigerating compartment may be maintained at a temperature of approximately 3° C., allowing food to be refrigerated, and the freezing compartment may be maintained at a temperature of approximately −18.5° C., allowing food to be frozen.

In addition, unlike the embodiment, the refrigerator 1 may be a Side By Side (SBS) type in which the storage compartment is divided into left and right sides by the vertical partition wall 16, and may be a French Door Refrigerator (FDR) type in which the storage compartment is divided into an upper refrigerating compartment and a lower freezing compartment by the horizontal partition wall 15.

Inside the plurality of storage compartments 21, 22, and 23, a shelf 26 for placing food and a storage container 27 for storing food may be provided.

The cooling device 520 may generate cold air using a cooling cycle of compressing, condensing, expanding, and evaporating the refrigerant, and may supply the generated cold air to the plurality of storage compartments 21, 22, and 23. To this end, the cooling device 520 may include a compressor, a condenser, an expander, and an evaporator.

According to various embodiments, the cooling device 520 may be provided in at least one of the plurality of storage compartments 21, 22, or 23. For example, the cooling device 520 may be provided only in the upper storage compartment 21, only in the lower storage compartments 22 and 23, or in each of the upper storage compartment 21 and the lower storage compartments 22 and 23.

Accordingly, the cooling device 520 may cool at least one storage compartment 21, 22, or 23.

Temperature sensors T11 and T22 may be arranged in at least one storage compartment 21, 22, or 23.

For example, the temperature sensor may include the first temperature sensor T11 to detect a temperature of the first storage compartment 21, and the second temperature sensor T22 to detect a temperature of the second storage compartment 22 and/or the third storage compartment 23.

The refrigerating compartment may be opened and closed by a pair of doors. A pair of doors may be rotatably coupled to the main body. The pair of doors may include a first door 31 and a second door 32.

The first door 31 of the pair of doors may be provided with a filler 43 to prevent cold air from leaking between the pair of doors upon closing the pair of doors.

The second storage compartment 22, which is the left freezing compartment, may be opened and closed by the third door 33, and the third door 33 may be rotatably coupled to the main body.

The third storage compartment 23, which is the right freezing compartment, may be opened and closed by the fourth door 34, and the fourth door 34 may be rotatably coupled to the main body.

The plurality of doors 31, 32, 33, and 34 may include door baskets 39 and 40 including a door storage space for storing food. A gasket in close contact with a front surface of the main body may be provided on rear surfaces of the plurality of doors 31, 32, 33, and 34 to seal the plurality of storage compartments 21, 22, and 23.

At least one of the plurality of doors 31, 32, 33, or 34 may be configured as a double door including an inner door 35 and an outer door 36. For example, the first door 31 may include the inner door 35 and the outer door 36.

The inner door 35 may be rotatably coupled to the main body through a hinge. The inner door 35 may include a door inner space. The door inner space may be formed in a central portion excluding an edge portion of the inner door 35. The door inner space may be formed to extend between the front and back surfaces of the inner door 35. Accordingly, in response to the inner door 35 being closed, the door inner space may communicate with the refrigerating compartment.

The door baskets 39 and 40 may be mounted in the door inner space.

A dispenser (not shown) may be provided in the door inner space. In addition, in the door inner space, a water container mounting space 72 in which a water container is mounted, and an automatic water supply device including a water level sensor (not shown) for detecting a water level of the water container in response to the water container being mounted in the water container mounting space 72 may be provided.

In response to the water container being mounted in the water container mounting space 72 through the automatic water supply device, the water container may be filled with a predetermined amount of water. In other words, the automatic water supply device may perform an auto-fill function.

A water supply device 50 may be disposed in at least one storage compartment 21, 22, or 23.

The water supply device 50 may be provided to purify and store water supplied from an external water supply source (not shown). The water supply device 50 may include a filter and a water tank.

The water supply device 50 may be arranged on one side of the refrigerating compartment 21. For example, the water supply device 50 may be arranged between a pair of storage containers 27 arranged side by side in the refrigerating compartment. However, the location of the water supply device 50 is not limited thereto. The water supply device 50 may be arranged at an appropriate position inside the refrigerating compartment.

An ice making unit 1000 may be arranged in the freezing compartment of the refrigerator 1. The ice making unit 1000 may produce ice using cold air of the freezing compartment. The ice making unit 1000 may be provided in the storage compartment.

For example, the ice making unit 1000 may be arranged in the second storage compartment 22, which is the left freezing compartment. More specifically, the ice making unit 1000 may be arranged in the upper left side of the left freezing compartment. However, the installation location of the ice making unit 1000 is not limited thereto, and the ice making unit 1000 may be arranged in the third storage compartment 23, which is the right freezing compartment.

According to an embodiment of the disclosure, the ice making unit 1000 may include at least one ice making device.

For example, the ice making unit 1000 may include a pair of ice making devices. A pair of ice making devices 200 and 400 may include the first ice making device 200 and the second ice making device 400. The first ice making device 200 and the second ice making device 400 may be arranged side by side on the left and right.

However, in an embodiment, the ice making unit 1000 may include only one of the first ice making device 200 or the second ice making device 400.

In a case where the ice making unit 1000 includes a plurality of ice making devices, for example, in a case where the ice making unit 1000 includes the first ice making device 200 and the second ice making device 400, the first ice making device 200 and the second ice making device 400 may be configured to produce different types of ice. Accordingly, a user may select a desired type of ice from any one of the first ice making device 200 and the second ice making device 400.

In addition, because a plurality of ice making devices are provided, the amount of ice produced by the ice making unit 1000 may increase. A user may take out a relatively sufficient amount of ice compared to using the refrigerator 1 with a single ice making device.

The water supply device 50 may supply water to the ice making unit 1000. For example, the water supply device 50 may supply water to the ice tray of at least one ice making device included in the ice making unit 1000.

The water supply device 50 may include a first connection hose 51 that connects water supplied from an external water supply source to the first ice making device 200. In addition, the water supply device 50 may include a second connection hose 52 that connects water supplied from the external water supply source to the second ice making device 400.

According to an embodiment, the water supply device 50 may include a first water supply device 53 that supplies water to the first ice making device 200, and a second water supply device that supplies water to the second ice making device 400.

The first water supply device 53 may include a first water supply valve 51*a* for opening and closing the first connection hose 51. The first water supply valve 51*a* may open and close a water supply passage connected to the first ice making device 200.

In addition, the second water supply device 54 may include a second water supply valve 52*a* for opening and closing the second connection hose 52. The second water supply valve 52*a* may open and close a water supply passage connected to the second ice making device 400.

The water supply device 50 may supply water to the first ice making device 200 through the first connection hose 51 by opening the first water supply valve 51*a*. In addition, the water supply device 50 may supply water to the second ice making device 400 through the second connection hose 52 by opening the second water supply valve 52*a*.

The refrigerator 1 may include flow sensors 51*b* and 52*b* for detecting the amount of water supplied to the water supply device 50. For example, the water supply device 50 may itself include the flow sensors 51*b* and 52*b* to detect the amount of water supplied.

The flow sensors 51*b* and 52*b* may include the first flow sensor 51*b* that is provided downstream of the first water supply valve 51*a* to detect the amount of water supplied to the first ice making device 200, and/or the second flow sensor 52*b* that is provided downstream of the second water supply valve 52 to detect the amount of water supplied to the second ice making device 400.

The flow sensors 51*b* and 52*b* may detect the amount of water supplied to the ice making devices 200 and 400, and more specifically, detect the amount of water supplied to the ice trays 170, 270, and 410 of the ice making devices 200 and 400.

In an embodiment, the flow sensors 51*b* and 52*b* may include an impeller, and may include a circuit configuration that generates a pulse (=pulse signal) according to the rotation of the impeller.

When water passes through the flow sensors 51*b* and 52*b*, the impeller may rotate due to a pressure of the water, pulses may be generated according to the rotation of the impeller, and the amount of water passing through the flow sensors 51*b* and 52*b* may be measured according to the number of pulses.

Figure 4:
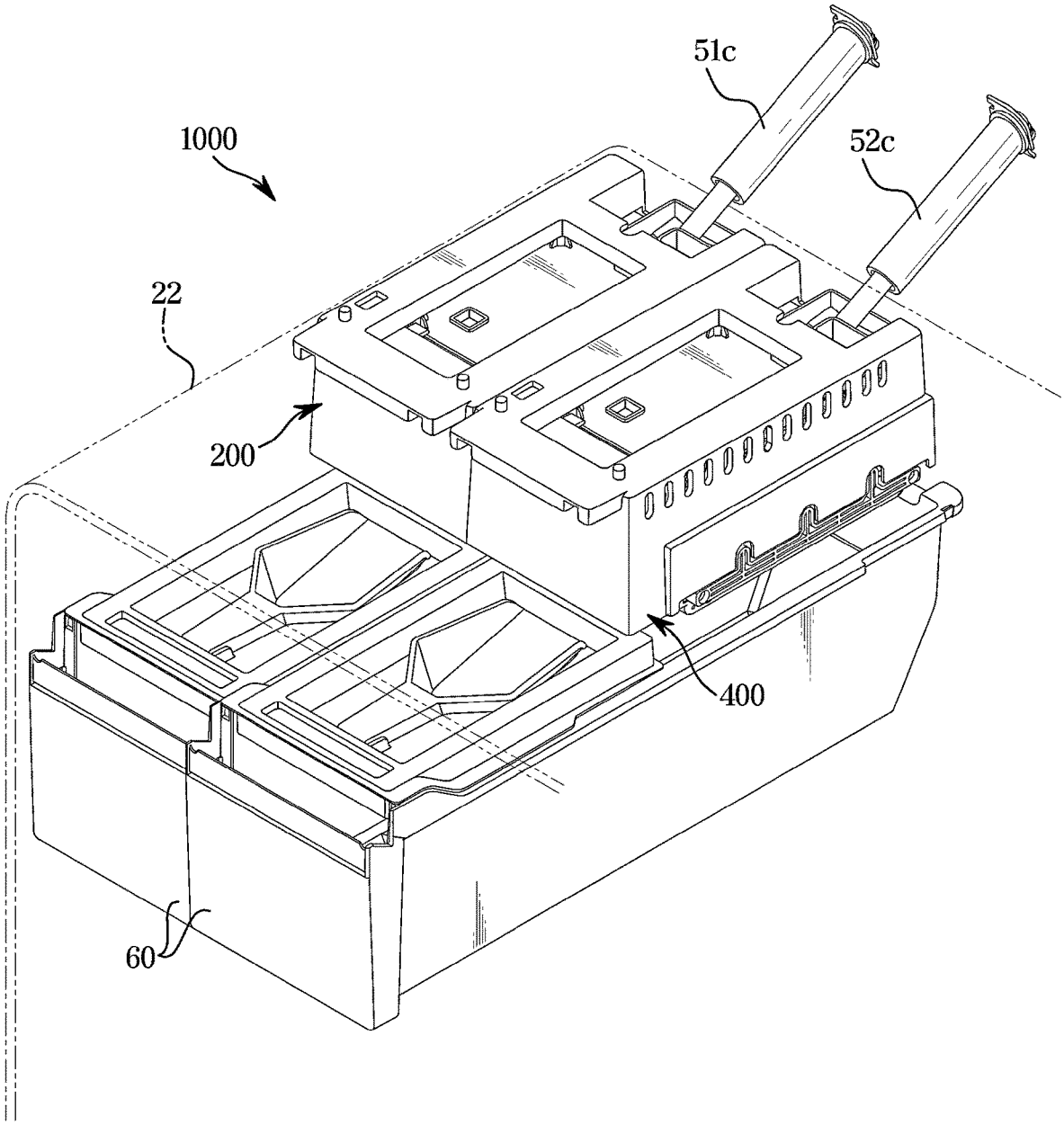
FIG. 4 is an enlarged perspective view of the ice making unit of FIG. 3 according to an embodiment.

FIG. 4 is an enlarged perspective view of the ice making unit of FIG. 3.

Referring to FIG. 4, water supplied from an external water supply source may be supplied to the first ice making device 200 through the first water supply device 53, and water supplied from the external water supply source may be supplied to the second ice making device 200 through the second water supply device 54. The first water supply device 53 and the second water supply device 54 may be provided on an upper portion of an ice making housing 100 by penetrating the inner case 11.

The first water supply device 53 and the second water supply device 54 may include a first water supply pipe 51*c* and/or a second water supply pipe 52*c* that guide water in the first connection hose 51 and the second connection hose 52 to the first ice making device 200 and the second ice making device 400, respectively. The first water supply pipe 51*c* and the second water supply pipe 52*c* may be made of metal, for example, aluminum. An insulating portion (not shown) may be provided to cover at least a portion of the first water supply pipe 51*c* and the second water supply pipe 52*c*. In addition, although not specifically illustrated, the first water supply pipe 51*c* and the second water supply pipe 52*c* may include a heater (not shown), thereby preventing the water inside the first water supply pipe 51*c* and the second water supply pipe 52*c* from freezing and blocking an inlet and an outlet of the first water supply pipe 51*c* and the second water supply pipe 52*c*.

The ice making unit 1000 may include the ice making housing 100 to accommodate the first ice making device 200 and/or the second ice making device 400.

The first ice making device 200 and/or the second ice making device 400 may produce ice by cooling the water supplied from the water supply device 50.

In addition, the ice making unit 1000 may include an ice bucket 60 to store ice produced by the first ice making device 200 and/or the second ice making device 400.

The ice bucket 60 may be mounted on one side of the ice making housing, and may include a first ice bucket for storing ice produced by the first ice making device 200 and a second ice making device 400 for storing ice produced by the second ice making device 400.

The first ice making device 200 and the second ice making device 400 may produce different shapes and/or sizes of ice.

For example, the first ice making device 200 may produce spherical ice. The spherical ice may also be referred to as craft ice.

In addition, the second ice making device 400 may produce ice in a form other than spherical ice. For example, the second ice making device 400 may produce ice cubes.

However, the type of ice produced by the first ice making device 200 and the second ice making device 400 is not limited thereto.

Figure 5:
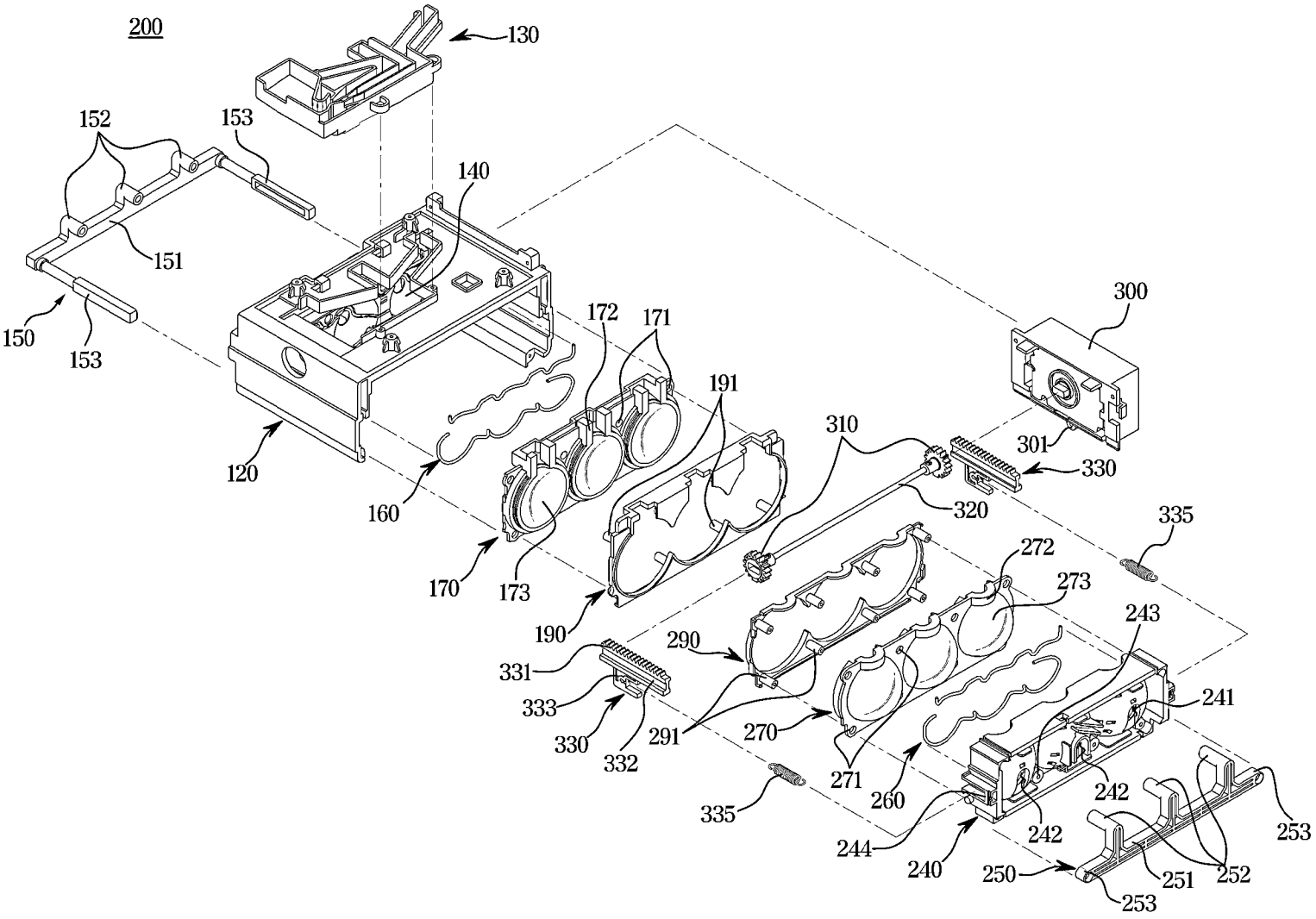
FIG. 5 illustrates an example of an ice making device constituting the ice making unit of FIG. 4 according to an embodiment.

FIG. 5 illustrates an example of an ice making device constituting the ice making unit of FIG. 4.

Referring to FIG. 5, the first ice making device 200 may include a cover frame 120. The cover frame 120 may be coupled to the ice making housing 100 inside the ice making housing 100 (see FIG. 3). The cover frame 120 may be provided in a box shape with approximately one side and bottom open.

The first ice making device 200 may include a water path 130. The water path 130 may be mounted on one side of the cover frame 120. Specifically, the water path 130 may be mounted on an upper surface of the cover frame 120. The water path 130 may be provided to move water supplied from the water supply device 50 to the inside of the cover frame 120. In other words, the water path 130 may transfer the water supplied from the water supply device 50 to the ice trays 170 and 270.

The ice trays 170 and 270 may include the first ice tray 170 and the second ice tray 270.

That is, the water path 130 may be provided to move water supplied from the water supply device 50 into the first ice tray 170 and the second ice tray 270.

The first ice making device 200 may include a first case 140 formed on the cover frame 120, a first fixing frame 190, a first heating device 160 and the first ice tray 170 accommodated in the first case 140.

The first case 140 may be formed on one side of the cover frame 120. The first case 140 may be formed integrally with the cover frame 120, or may be provided as a separate member coupled to one side of the cover frame 120.

The first case 140 may accommodate the first ice tray 170. A structure of the first case 140 will be described in detail later with reference to FIG. 8.

The first ice tray 170 may be disposed in the ice making housing 100. More specifically, the first ice tray 170 may be mounted within the cover frame 120. The first ice tray 170 may be made of an elastic material.

The first ice tray 170 may be supplied with water from the water supply device 50. The first ice tray 170 may include a first guide portion 172 to allow supplied water to flow into an ice making cell in the first ice tray 170. The first guide portion 172 may be formed on an upper side of the first ice tray 170.

The first ice tray 170 may include a first ice making cell 173 provided to form a portion of ice. The first ice making cell 173 may be provided in a substantially circular shape. Accordingly, the ice produced by the first ice making device 200 may have a spherical shape. In the first ice making device 200 of the refrigerator 1 according to an embodiment of the disclosure, three first ice making cells 173 are illustrated and described, but the number of first ice making cells 173 is not limited thereto.

The first ice tray 170 may include a first insertion hole 171. A plurality of first insertion holes 171 may be provided.

The first insertion hole 171 may be provided to allow a first coupling protrusion 191 of the first fixing frame 190 to be inserted. Through the above, the first fixing frame 190 may fix the first ice tray 170 to the first case 140. In other words, the first fixing frame 190 may fix the first ice tray 170 to one side of the cover frame 120.

The first fixing frame 190 may include the first coupling protrusion 191. A plurality of first coupling protrusions 191 may be provided corresponding to the number of first insertion holes 171. The first coupling protrusion 191 may extend from one side of the first fixing frame 190 toward the first ice tray 170. The first coupling protrusion 191 may be inserted into a first through hole 142 of the first case 140, which will be described later, and may be coupled to the first case 140.

The first fixing frame 190 may support an edge of the first ice making cell 173 of the first ice tray 170. Because the first ice tray 170 is made of an elastic material, insufficient rigidity of the first ice tray 170 may be reinforced by the first fixing frame 190.

The first ice making device 200 may include the first heating device 160. The first heating device 160 may be disposed between the first ice tray 170 and the first case 140. More specifically, the first heating device 160 may be disposed between the first ice tray 170 and the cover frame 120. By disposing the first heating device 160 on one side of the first ice tray 170, ice may be easily separated from the first ice making cell 173 after ice production is completed in the first ice making cell 173 of the first ice tray 170.

Accordingly, the first case 140 formed on one side of the cover frame 120, the first heating device 160, the first ice tray 170, and the first fixing frame 190 may be fixed to one side of the cover frame 120.

The first ice making device 200 may include a second case 240, a second heating device 260, a second fixing frame 290, and the second ice tray 270 accommodated in the second case 240.

The second case 240 may be movable in the cover frame 120.

The second case 240 may accommodate the second ice tray 270.

The second case 240 may include a second tray mounting portion 241. The second tray mounting portion 241 may accommodate a second ice making cell 273 of the second ice tray 270. Three second tray mounting portions 241 may be provided corresponding to the number of second ice making cells 273.

The second case 240 may include a second through hole 242. The second through hole 242 may be formed by cutting the second tray mounting portion 241. The second through hole 242 may be provided to allow a pressing portion of a second ejector 250 to be described later to be penetrated.

The second case 240 may include a second fixing portion 243. The second fixing portion 243 may be provided to allow a second coupling protrusion 291 of the second fixing frame 290, which will be described later, to be inserted.

The second case 240 may include a second elastic member mounting portion 244. An elastic member 335 connecting a rack gear 330 to be described later and the second case 240 may be mounted on the second elastic member mounting portion 244.

The second case 240 may include a protrusion 245. The protrusion 245 may extend outward from a side surface of the second case 240. The protrusion 245 may be inserted into a leg portion 153 of a first ejector 150, which will be described in detail later.

The second ice tray 270 may be disposed in the ice making housing 100. More specifically, the second ice tray 270 may be mounted within the cover frame 120. The second ice tray 270 may be made of an elastic material. The second ice tray 270 may be engaged with the first ice tray 170 to form a remaining portion of ice.

The second ice tray 270 may receive water from the water supply device 50. The second ice tray 270 may include a second guide portion 272 to allow supplied water to flow into the second ice making cell 273 in the second ice tray 270. The second guide portion 272 may be formed on an upper side of the second ice tray 270.

The second ice tray 270 may include the second ice making cell 273 provided to form the remaining portion of ice. The second ice making cell 273 may be provided in a substantially circular shape. Accordingly, the ice produced by the first ice making device 200 may have a spherical shape. In the first ice making device 200 of the refrigerator 1 according to an embodiment of the disclosure, three second ice making cells 273 are illustrated and described, but the number of second ice making cells 273 is not limited thereto.

The second ice tray 270 may include a second insertion hole 271. A plurality of second insertion holes 271 may be provided.

The second insertion hole 271 may be provided to allow the second coupling protrusion 291 of the second fixing frame 290 to be inserted. Through the above, the second fixing frame 290 may fix the second ice tray 270 to the second case 240. In other words, the second fixing frame 290, the second ice tray 270, and the second case 240 may be driven integrally.

The second fixing frame 290 may include the second coupling protrusion 291. A plurality of second coupling protrusions 291 may be provided corresponding to the number of second insertion holes 271. The second coupling protrusion 291 may extend from one side of the second fixing frame 290 toward the second ice tray 270. The second coupling protrusion 291 may be inserted into the second through hole 242 of the second case 240 and may be coupled to the first case 140. That is, the second coupling protrusion 291 may penetrate the second insertion hole 271 of the second ice tray 270 and may be coupled to the second through hole 242 of the second case 240.

The second fixing frame 290 may support an edge of the second ice making cell 273 of the second ice tray 270. Because the second ice tray 270 is made of an elastic material, insufficient rigidity of the second ice tray 270 may be reinforced by the second fixing frame 290.

The first ice making device 200 may include the second heating device 260. The second heating device 260 may be disposed between the second ice tray 270 and the second case 240. By disposing the second heating device 260 on one side of the second ice tray 270, ice may be easily separated from the second ice making cell 273 after ice production is completed in the second ice making cell 273 of the second ice tray 270.

In addition, the first heating device 160 and the second heating device 260 may heat water stored between the first ice tray 170 and the second ice tray 270.

Accordingly, the second case 240, the second heating device 260, the second ice tray 270, and the second fixing frame 290 may be operated integrally on the other side of the cover frame 120. In addition, the second case 240, the second heating device 260, the second ice tray 270, and the second fixing frame 290 may move horizontally with respect to the cover frame 120. In other words, the second ice tray 270 for forming ice may be provided to move horizontally with respect to the first ice tray 170.

The first ice making device 200 may include the first ejector 150 and the second ejector 250.

The first ejector 150 may press(push) the first ice tray 170. More specifically, the first ejector 150 may press the first ice making cell 173 of the first ice tray 170.

The first ejector 150 may include a first body 151, a first pressing portion 152, and the leg portion 153.

The first body 151 may be formed to extend in a direction parallel to the second case 240. That is, the first body 151 may extend along a direction perpendicular to a moving direction of the first ejector 150.

The first pressing portion 152 may extend from the first body 151. The first body 151 may support the first pressing portion 152.

The first ejector 150 may pass through the first through hole 142 formed in the first case 140. Specifically, the first pressing portion 152 of the first ejector 150 may pass through the first through hole 142 to press the first ice tray 170.

The first ejector 150 may be movable with respect to the cover frame 120. The first ejector 150 may be movable based on the movement of the second case 240.

The second ejector 250 may be fixed to one side of the cover frame 120. The second ejector 250 may press the second ice tray 270. More specifically, the second ejector 250 may press the second ice making cell 273 of the second ice tray 270.

The second ejector 250 may include a second body 251, a second pressing portion 252, and frame coupling portions 253. The second body 251 may extend in a direction parallel to the second case 240. The second pressing portion 252 may extend from the second body 251 toward the second case 240. The frame coupling portions 253 may be formed at both ends of the second body 251 and may be coupled to the cover frame 120.

The second ejector 250 may pass through the second through hole 242 formed in the second case 240. Specifically, the second pressing portion 252 of the second ejector 250 may pass through the second through hole 242 to press the second ice tray 270.

That is, the second ejector 250 is fixed to the cover frame 120, and the second ice tray 270 moves with respect to the cover frame 120, and thus the second ejector 250 may press the second ice tray 270.

The first ice making device 200 may include a driver 300, a pinion 310, a bar 320, a rack gear 330, and an elastic member 335.

The driver 300 may generate power. Various electronic components such as a motor and a circuit board may be disposed in the driver 300. The driver 300 may be coupled to the cover frame 120.

The pinion 310 may be coupled to the driver 300 to transmit power generated from the driver 300. A pair of pinions 310 may be provided. The pair of pinions 310 may be connected by the bar 320. The pinion 310 may be rotate according to the driving of the driver 300. The pinion 310 may be provided in a sawtooth shape to engage with the rack gear 330.

The rack gear 330 may be movable with respect to the cover frame 120. More specifically, the rack gear 330 may be moved linearly based on the rotational movement of the pinion 310.

The rack gear 330 may include a support portion 332 supported by the cover frame 120. The rack gear 330 may include a toothed portion 331 formed on an upper surface of the support portion 332. The toothed portion 331 of the rack gear 330 and the pinion 310 may be engaged to allow the rack gear 330 to move horizontally with respect to the cover frame 120.

The rack gear 330 may include a first elastic member mounting portion 333 extending from the support portion 332. The elastic member 335 may be mounted on the first elastic member mounting portion 333.

That is, the pinion 310 and the rack gear 330 are engaged to convert the rotational movement of the driver 300 into linear movement. However, the embodiment of the disclosure is not limited thereto, and any structure that may convert rotational movement into linear movement may be applied.

The elastic member 335 may connect the rack gear 330 and the second case 240. That is, the rack gear 330 and the second case 240 may be connected.

Through the above, the rack gear 330 receives power from the driver 300 and moves, and thus the second case 240 may move horizontally with respect to the cover frame 120 in conjunction with the movement of the rack gear 330. In other words, the second ice tray 270 and the second case 240 may move linearly with respect to the cover frame 120 by the rack gear 330.

That is, the movement of the second case 240 is operated integrally with the second ice tray 270, the second heating device 260, and the second fixing frame 290, thereby allowing the second ice tray 270 to move horizontally with respect to the first ice tray 170.

The first ice making device 200 may include a full ice detection sensor 301 for detecting a full state of ice stored in the ice bucket 60.

Detecting the full state in the ice bucket 60 refers to detecting whether the ice bucket 60 is full of ice.

In an embodiment, the full ice detection sensor 301 may include a light emitter that emits light toward the ice bucket 60 and a light receiver that receives light reflected from the ice accommodated in the ice bucket 60. The full ice detection sensor 301 may detect the full state of ice based on an intensity of light received from the light receiver.

In another embodiment, the full ice detection sensor 301 may be implemented in a form of a detection lever that detects physical contact with the ice in an upper end of the ice bucket 60.

However, the full ice detection sensor 301 is not limited thereto, and any sensor that may detect whether the ice bucket 60 is full of ice may be employed as the full ice detection sensor 301 without limitation.

The driver may separate the first ice tray and the second ice tray by transmitting power to the pinion 310. Accordingly, the ice formed in the first ice tray and the second ice tray may fall into the ice bucket 60.

That is, upon completion of ice production in the first ice making cell 173 and the second ice making cell 273, the pinion 310 and the bar 320 may rotate counterclockwise by the driver 300, and thus the rack gear 330 and the second case 240 connected thereto move to the other side of the cover frame 120. As the second case 240 moves away from the first case 140, the first ice tray 170 and the second ice tray 270 may be separated.

In this instance, in a case where a piece of ice formed between the first ice tray 170 and the second ice tray 270 is attached to one of the ice trays 170 or 270, the ice may be pressed by the ejectors 150 and 250 as the pinion 310 and the bar 320 continue to rotate counterclockwise by the driver 300, and as a result, the ice may be separated from the ice trays 170 and 270.

In response to the ice being separated from the first ice tray 170 and the second ice tray 270, the pinion 310 and the bar 320 may rotate clockwise by the driver 300, and as a result, the rack gear 330 and the second case 240 connected thereto move toward the cover frame 120. As the second case 240 moves closer to the first case 140, the first ice tray 170 and the second ice tray 270 may come into contact with each other.

As such, an operation of separating the ice formed in the first ice making cell 173 and the second ice making cell 273 from the ice trays 170 and 270 is referred to as an ice separating operation (ice releasing operation).

Accordingly, the driver 300 that performs the ice separating operation may be referred to as the ice separator 300.

In summary, the first ice making device 200 may cool water supplied from the water supply device 50 to produce spherical ice and provide the spherical ice to the ice bucket 60.

Figure 6:
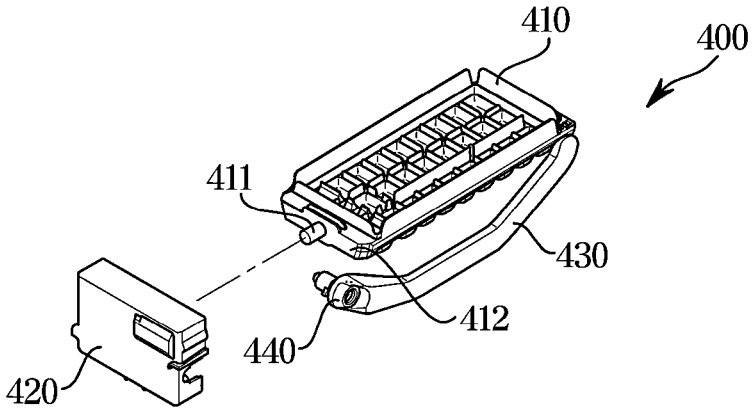
FIG. 6 illustrates another example of an ice making device constituting the ice making unit of FIG. 4 according to an embodiment.

FIG. 6 illustrates another example of an ice making device constituting the ice making unit of FIG. 4.

The second ice making device 400 is a commonly used ice making device, and description of components that overlap with those of the first ice making device 200 (e.g., water path 130) will be omitted.

Referring to FIG. 6, the second ice making device 400 may include an ice tray 410.

The ice tray 410 may form ice cubes. More specifically, the ice tray 410 may include at least one ice making cell that stores water. Each ice making cell may be partitioned by a partition wall.

The ice tray 410 may include a rotation shaft 411. The rotation shaft 411 may protrude from the front/rear of the ice tray 410 to the outside of the ice tray 410.

The second ice making device 400 may include a driver 420.

The driver 420 may be coupled to the front of the rotation shaft 411 to rotate the ice tray 410.

The driver 420 may include various electronic components such as a motor that generates power, a power transmission gear, a circuit board, and the like. The driver 420 may be fixed to the inside of the ice making housing 100.

The second ice making device 400 may include a full ice detection lever 430 and a second lever mounting portion 440.

The full ice detection lever 430 may detect whether the ice bucket 60 disposed below the second ice making device 400 is full of ice. The full ice detection lever 430 may be coupled to a case of the driver 420 by the second lever mounting portion 440.

The full ice detection lever 430 may be rotatably coupled to the case of the driver 420. More specifically, the full ice detection lever 430 may rotate in a vertical direction around the second lever mounting portion 440 coupled to the case of the driver 420 as an axis.

The lever mounting portion 440 may be coupled to a side of the case of the driver 420 to connect the full ice detection lever 430 and the case of the driver 420. However, the lever mounting portion 440 is not limited thereto and may be formed integrally with the case of the driver 420.

As described above, the full ice detection lever 430 may be replaced with other types of full ice detection sensors 301 and 430. For example, the full ice detection lever 430 may be replaced by the full ice detection sensors 301 and 430 that include a light emitter and a light receiver.

The ice tray 410 may include a motor coupling portion 412. The motor coupling portion 412 may be formed in a front portion of the ice tray 410 and may be connected to the driver 420.

The driver 420 may rotate the ice tray 410 by transmitting power to the rotation shaft 411, and thus the ice produced in the ice tray 410 may fall into the ice bucket 60.

As such, an operation of separating the ice formed in the ice tray 410 from the ice tray 410 is referred to as an ice separating operation.

Accordingly, the driver 420 that performs the ice separating operation may be referred to as the ice separator 420.

Although the ice making unit 1000 including a plurality of ice making devices has been described above, the number and type of ice making devices of the ice making unit 1000 are not limited thereto.

According to various embodiments, the refrigerator 1 may include only the first ice making device 200, or may include both the first ice making device 200 and the second ice making device 400.

Figure 7:
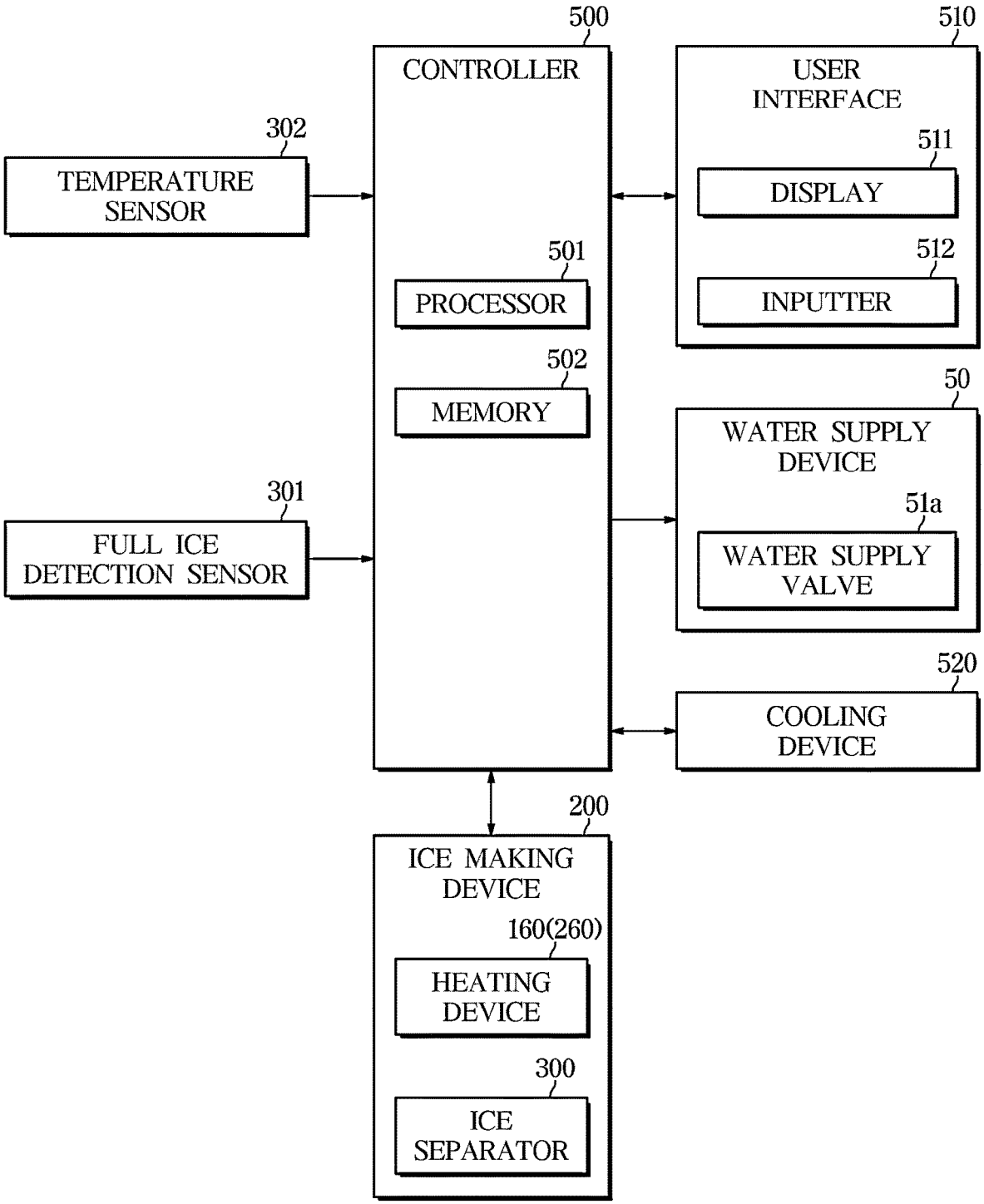
FIG. 7 is a control block diagram of a refrigerator according to an embodiment.

FIG. 7 is a control block diagram of a refrigerator according to an embodiment.

Hereinafter, a method for controlling the first ice making device 200 producing spherical ice is described.

Referring to FIG. 7, the refrigerator 1 may include the above-described components and a controller 500 for controlling the above-described components.

In an embodiment, the refrigerator 1 may include a temperature sensor 302, the water supply device 50, the full ice detection sensor 301, the ice making device 200, a user interface 510, the cooling device 520, and the controller 500.

According to various embodiments, the user interface 510 may be implemented as a control panel, and may include an inputter 512 for receiving user input, and a display 511 for displaying information related to an operation of the refrigerator 1.

The inputter 512 may include a variety of input devices, such as a tact switch, push switch, slide switch, toggle switch, micro switch, touch switch, touch screen, button, or the like.

The display 511 may be implemented as various types of displays known in the art, such as, but not limited to, Liquid Crystal Display (LCD), Light Emitting Diode (LED), Plasma Display Panel (PDP), Organic Light Emitting Diode (OLED), Cathode Ray Tube (CRT), and the like. Any device capable of visually displaying various information about the refrigerator 1 and displaying a user interface capable of receiving various control commands from a user may be employed as the display 511 without limitation.

According to an embodiment, the refrigerator 1 may display, on the display 511, a user interface that may not only provide various information to a user, but may also receive various control commands about the refrigerator 1.

In an embodiment, the temperature sensor 302 may be provided in the main body 10 and may detect temperatures at various locations in the main body 10.

For example, the temperature sensor 302 may include the first temperature sensor T11 for detecting a temperature of the first storage compartment 21, and the second temperature sensor T22 for detecting a temperature of the second storage compartment 22 and/or the third storage compartment 23.

In another example, the temperature sensor 302 may include a temperature sensor 302 disposed downstream of an evaporator constituting the cooling device 520.

In still another example, the temperature sensor 302 may be provided in the ice making unit 1000, and may detect an air temperature inside the ice making device 200.

The full ice detection sensor 301 may detect whether the ice bucket 60 accommodating ice produced by the ice making device 200 is full of ice.

The water supply device 50 may supply water to the ice trays 170 and 270 of the ice making device 200. Supplying water to the ice trays 170 and 270 may include supplying water to ice making cells formed as the first ice tray 170 and the second ice tray 270 come into contact with each other.

The water supply valve 51*a* may open and close the water supply passage connected to the ice making device 200.

The cooling device 520 may include a compressor, a condenser, an expander, and an evaporator. The controller 500 may control temperatures of the storage compartments 21, 22, and 23 by controlling the compressor of the cooling device 520.

In an embodiment, the cooling device 520 supplies cold air to the freezing compartment 22, thereby supplying cold air to the ice making device 200 provided in the freezing compartment 22.

According to various embodiments, the cooling device 520 may directly transfer cold air to the ice making device 200. To this end, the cooling device 520 may be provided in the ice making unit 1000.

The ice making device 200 may include the heating devices 160 and 260 and the ice separator 300.

The heating devices 160 and 260 may heat water stored in the ice tray. In addition, the heating devices 160 and 260 may heat ice stored in the ice trays 170 and 270. That is, the heating devices 160 and 260 may heat the ice trays 170 and 270.

In an embodiment, the heating devices 160 and 260 may heat an ice making cell formed as the first ice tray 170 and the second ice tray 270 come into contact with each other.

The ice separator 300 may perform an ice separating operation to separate the ice formed in the first ice making cell 173 and the second ice making cell 273 from the ice trays 170 and 270. That is, the ice separator 300 may separate the ice accommodated in the ice trays 170 and 270 from the ice trays 170 and 270.

The controller 500 may include a processor 501 generating a control signal for operation of the refrigerator 1, and a memory 502 storing programs, applications, instructions, and/or data for operation of the refrigerator 1. The processor 501 and the memory 502 may be implemented as separate semiconductor devices, or may be implemented as a single semiconductor device. In addition, the controller 500 may include a plurality of processors 501 or a plurality of memories 502. The controller 500 may be arranged in various locations in the refrigerator 1. For example, the controller 500 may be included on a printed circuit board arranged in a control panel.

The processor 501 may include arithmetic circuit, memory circuit, and control circuit. The processor 501 may include a single chip or a plurality of chips. In addition, the processor 501 may include a single core or a plurality of cores.

The memory 502 may store a program for performing a water supply operation and ice making cycle, and may store data required to perform the water supply operation and ice making cycle.

The memory 502 may include a volatile memory, such as Static Random Access Memory (S-RAM) and Dynamic Random Access Memory (D-RAM), and a non-volatile memory, such as Read Only Memory (ROM) and Erasable Programmable Read Only Memory (EPROM). The memory 502 may include a single memory device or may include a plurality of memory devices.

The processor 501 may process the data and/or signals using the programs provided from the memory 502, and may transmit control signals to each component of the refrigerator 1 based on the results of the processing. For example, the processor 501 may process a user input received via the user interface 510, data about the temperatures of the storage compartments 21, 22, and 23 detected by the temperature sensor 302, information about a full state of ice detected by the full ice detection sensor 301, and the like.

The water supply device 50, the user interface 510, the cooling device 520, and the ice making device 200 may be operated based on a control signal of the controller 500.

In an embodiment, the controller 500 may control the user interface 510 to display various information.

In addition, the controller 500 may control the cooling device 520 to maintain at least one storage compartment 21, 22, or 23 at a predetermined temperature.

In addition, the controller 500 may control the ice making device 200 to perform an ice making cycle.

In an embodiment, based on a predetermined condition being satisfied, the controller 500 may operate the water supply device 50 to supply water to the ice trays 170 and 270. Also, based on a predetermined condition being satisfied, the controller 500 may stop the operation of the water supply device 50 to stop water supply.

For example, the controller 500 may start a water supply operation based on the ice making cycle being completed and the ice bucket 60 not being full of ice.

Operating the water supply device 50 to supply water to the ice trays 170 and 270 may include opening the water supply valve 51*a*. Stopping the operation of the water supply device 50 to stop water supply may include closing the water supply valve 51*a*.

During the water supply operation, the controller 500 may operate the water supply device 50, and may determine a time to stop operating the water supply device 50 based on the water supply amount detected by the flow sensors 51*b* and 52*b*.

The controller 500 may control the heating devices 160 and 260 to heat the ice trays 170 and 270 in a preset pattern while performing the ice making cycle.

In addition, the controller 500 may control the ice separator 300 to perform an ice separating operation as a process of the ice making cycle.

Figure 8:
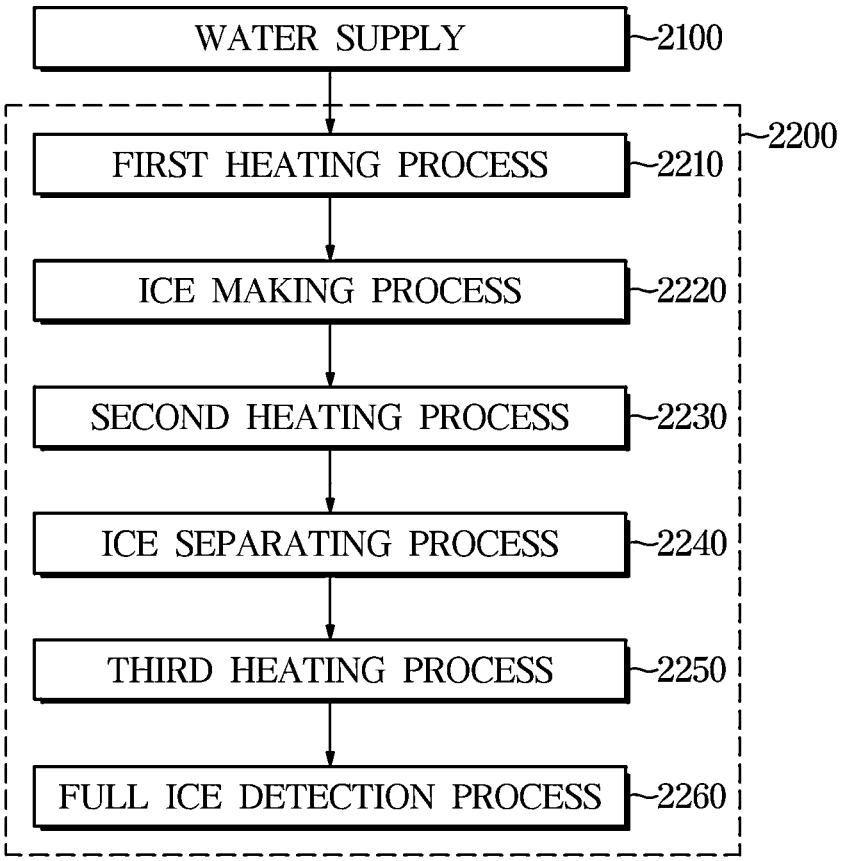
FIG. 8 is a flowchart illustrating an ice making cycle according to an embodiment.

FIG. 8 is a flowchart illustrating an ice making cycle according to an embodiment.

Referring to FIG. 8, an ice making cycle 2200 may be divided into several processes depending on its purpose.

Before the ice making cycle 2200 is performed, a water supply process 2100 may be performed.

The water supply process 2100 may be performed in response to the ice bucket 60 not being full of ice.

The controller 500 may operate the full ice detection sensor 301 in a full ice detection process 2260 to detect whether the ice bucket 60 is full of ice, and may perform the water supply process 2100 based on information obtained from the full ice detection sensor 301.

After the water supply process 2100 is completed, the ice making cycle 2200 may be performed.

The ice making cycle 2200 may include a first heating process 2210, an ice making process 2220, a second heating process 2230, an ice separating process 2240, a third heating process 2250, and the full ice detection process 2260.

The first heating process 2220 is a process for controlling a transparency of ice produced in the ice trays 170 and 270.

By heating the water stored in the ice trays 170 and 270, a solubility of gas decreases, causing various gases dissolved in the water to escape from the water. Accordingly, by supplying cold air while heating the water stored in the ice trays 170 and 270, ice with improved transparency may be produced.

In other words, the longer the heating devices 160 and 260 are operated, the more ice with improved transparency may be produced.

In the first heating process 2210, the heating devices 160 and 260 may operate in a preset pattern, thereby removing the gas dissolved in the water stored in the ice trays 170 and 270.

As will be descried later, the preset pattern varies depending on an ice making mode.

The ice making process 2220 is for cooling the water stored in the ice trays 170 and 270.

In the ice making process 2220, the heating devices 160 and 260 do not operate, and only the cold air supplied by the cooling device 520 is supplied to the ice making device 200.

The first heating process 2210 and the ice making process 2220 may be classified as one process.

The second heating process 2230 is a process for separating a surface of ice stored in the ice trays 170 and 270 from the ice trays 170 and 270.

In a case where ice is produced in the ice trays 170 and 270, the surface of the ice adheres to the ice trays 170 and 270. Accordingly, in the second heating process 2230, the surface of the ice is separated from the ice trays 170 and 270 by heating the surface of the ice.

The ice separating process 2240 is a process for separating the ice stored in the ice trays 170 and 270 from the ice trays 170 and 270, and moving the ice to the ice bucket 60.

In the ice separating process, the ice separator 300 performs an ice separating operation, and thus the ice formed in the ice trays 170 and 270 falls into the ice bucket 60.

The third heating process 2250 is a process for removing residual ice remaining in the ice trays 170 and 270 after the ice separating process 2240.

In the third heating process 2250, ice fragments remaining in the ice trays 170 and 270 are heated.

The full ice detection process 2260 is a process for detecting whether the ice bucket 60 is full of ice.

In the full ice detection process 2260, the full ice detection sensor 301 may operate to detect whether the ice bucket 60 is full of ice.

The water supply process 2100 may be performed based on detection of the full state of ice in the ice bucket 60 in the full ice detection process 2260.

Through the above flow, the ice bucket 60 may always be full of ice.

Meanwhile, in a state where a temperature around the ice making device 200 is high, ice may not be produced even though the ice making cycle is performed.

For example, in a case where the refrigerator 1 supplies water and then performs the ice making cycle immediately after the refrigerator 1 is installed, the time required to produce ice increases.

Moreover, because the heating devices 160 and 260 are operated in the first heating process 2210, the temperature around the ice making device 200 is not easily lowered during the ice making cycle, and thus ice may not be easily produced.

As will be described later, according to the disclosure, a speed of initial ice production may be improved in a state where a temperature around the ice making device 200 is high.

Figure 9:
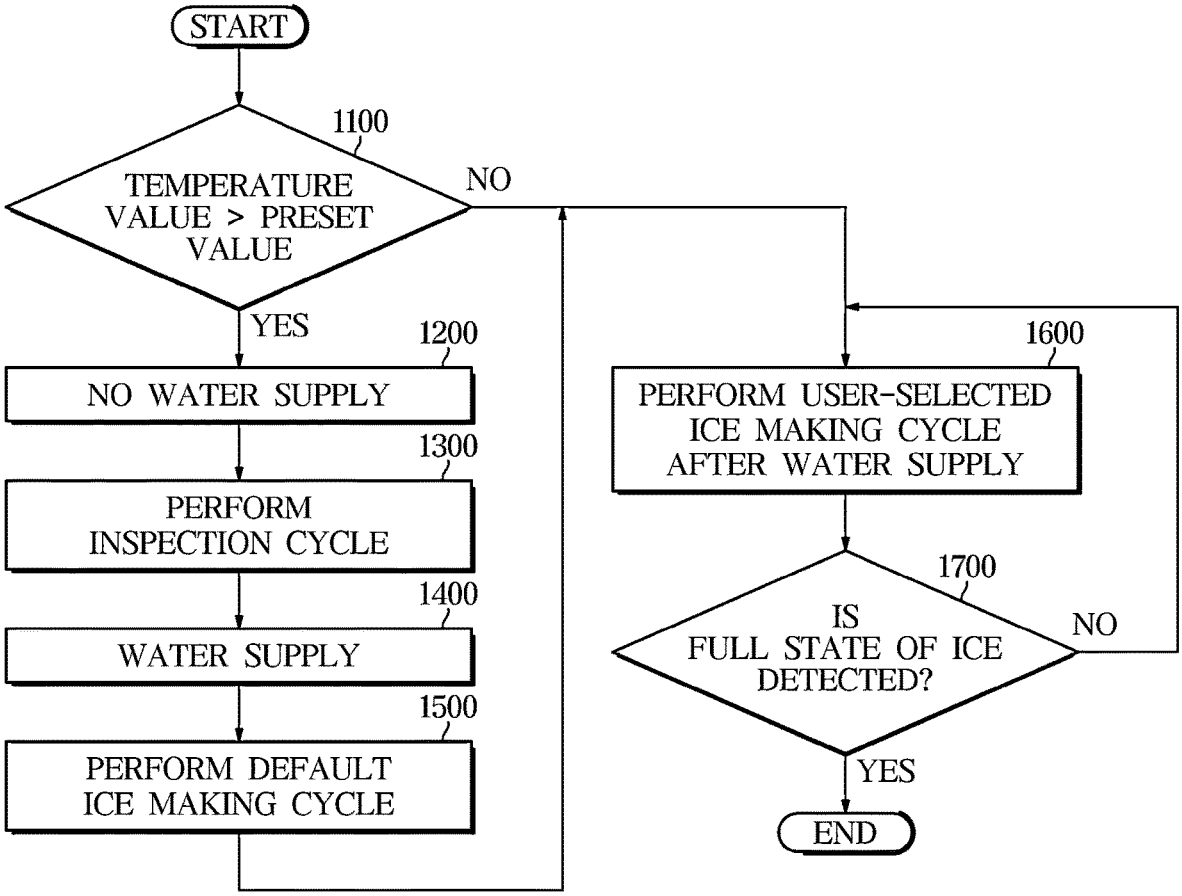
FIG. 9 is a flowchart illustrating a method for controlling a refrigerator according to an embodiment.

FIG. 9 is a flowchart illustrating a method for controlling a refrigerator according to an embodiment.

Referring to FIG. 9, based on a temperature value detected by the temperature sensor 302 being greater than a preset value (Yes in 1100), the controller 500 may control the water supply device 50 not to supply water to the ice trays 170 and 270 (1200), and may control the ice making device 200 to perform an inspection cycle (1300).

The temperature value detected by the temperature sensor 302 greater than the preset value may indicate that an ambient air temperature of the ice making device 200 (e.g., temperatures of the storage compartments 21, 22, and 23) is not low enough to produce ice.

For example, immediately after the refrigerator 1 is installed, a temperature value detected by the temperature sensor 302 may be greater than the preset value.

The preset value may be stored in the memory 502 and may be set to a temperature above 0 degrees Celsius.

In existing technology, regardless of a temperature value detected from a temperature sensor, a refrigerator is designed to control a water supply device to supply water to an ice tray and to control an ice making device to perform an ice making cycle according to a preset ice making mode.

Accordingly, according to the existing technology, in a case where a refrigerator is installed for the first time, ice production is delayed.

According to the disclosure, in response to the temperature value detected by the temperature sensor 302 being greater than the preset value, the inspection cycle may be performed without supplying water to the ice trays 170 and 270. Accordingly, time until an ambient air temperature of the ice making device 200 reaches a temperature suitable for producing ice may be secured.

In particular, according to the disclosure, by not operating the heating devices 160 and 260 in the first heating process 2210, the time required for the ambient air temperature of the ice making device 200 to reach a temperature suitable for producing ice may be reduced.

In addition, according to the disclosure, in response to the temperature value detected by the temperature sensor 302 being greater than the preset value, a malfunction of the ice making device 200 may be detected by performing the inspection operation on the ice making device 200.

FIG. 10 illustrates an example of a lookup table of a first heating process stage according to an inspection mode.

An inspection cycle may also include a plurality of processes constituting an ice making cycle as described in FIG. 9.

For example, the inspection cycle may also include the first heating process 2210, the ice making process 2220, the second heating process 2230, the ice separating process 2240, the third heating process 2250, and the full ice detection process 2260.

However, the inspection cycle may not include some processes. For example, the inspection cycle may omit the second heating process 2230 and/or the third heating process 2230.

Referring to FIG. 10, the memory 502 may store a look-up table corresponding to the first heating process 2210.

The lookup table may include operation information of the heating devices 160 and 260 in the first heating process 2210 of the inspection cycle.

In the first heating process 2210 of the inspection cycle, the heating devices 160 and 260 may not operate. That is, the controller 500 may not operate the heating devices 160 and 260 in the first heating process 2210 of the inspection cycle.

However, it may take a predetermined time t0 until the first heating process 2210 is completed.

The predetermined time t0 may be set to approximately 6 minutes, but is not limited thereto.

As such, in the first heating process 2210 of the inspection cycle, the heating devices 160 and 260 may be operated at 0% duty for the predetermined time t0. Operating the heating devices 160 and 260 at 0% duty refers to not operating the heating devices 160 and 260.

That is, the controller 500 may perform the first heating process 2210 based on an algorithm defined not to operate the heating devices 160 and 260 for the predetermined time t0.

Meanwhile, in the ice making process 2220 of the ice making cycle, the heating devices 160 and 260 are not operated and only cold air supplied by the cooling device 520 is supplied to the ice making device 200.

Likewise, in the ice making process 2220 of the inspection cycle, the heating devices 160 and 260 are not operated and only the cold supplied by the cooling device 520 is supplied to the ice making device 200.

The second heating process 2230 and/or the third heating process 2250 of the inspection cycle may be omitted.

In an embodiment, the second heating process 2230 of the inspection cycle may be omitted.

In a case where the second heating process 2230 of the inspection cycle is omitted, the controller 500 may perform the ice separating process 2240 by operating the ice separator 300 based on the completion of the ice making process 2220.

That is, in the inspection cycle, the controller 500 may operate the ice separator 300.

The controller 500 may detect whether the ice separator 300 is malfunctioning based on a value of driving current applied to the ice separator 300 in the ice separating process 2240 of the inspection cycle.

For example, the controller 500 may identify that the ice separator 300 is malfunctioning in response to the value of the driving current being within a predetermined range.

The controller 500 may perform the third heating process 2250 based on the completion of the ice separating process.

In the third heating cycle 2250 of the inspection cycle, the controller 500 may operate the heating devices 160 and 260 for a predetermined time. In this instance, the predetermined time may be set to a very short time.

For example, a time required for the third heating process 2250 of the inspection cycle may be shorter than a time required for the third heating process 2250 of the ice making cycle.

The controller 500 may detect whether the heating devices 160 and 260 are malfunctioning based on a value of current applied to the heating devices 160 and 260 in the third heating process 2250 of the inspection cycle.

According to various embodiments, the third heating process 2250 of the inspection cycle may be omitted.

In a case where the second heating process 2230 of the inspection cycle is omitted, the controller 500 may perform the second heating process 2230 based on the completion of the ice making process 2220, and then, based on the completion of the second heating process 2230, may perform the ice separating process 2240 by operating the ice separator 300.

In the second heating process 2230 of the inspection cycle, the controller 500 may operate the heating devices 160 and 260 for a predetermined time. In this instance, the predetermined time may be set to a very short time.

For example, a time required for the second heating process 2230 of the inspection cycle may be shorter than a time required for the second heating process 2230 of the ice making cycle.

According to various embodiments, the second heating process 2230 and the third heating process 2250 of the inspection cycle may be omitted.

That is, the controller 500 may operate only the ice separator 300 without operating the heating devices 160 and 260 in the inspection cycle.

In an embodiment, the controller 500 may perform the full ice detection process 2260 in the inspection cycle.

The controller 500 may operate the full ice detection sensor 301 in the full ice detection process 2260 of the inspection cycle. In the full ice detection process 2260 of the inspection cycle, the controller 500 may detect whether the ice separator 300 is malfunctioning based on data obtained from the full ice detection sensor 301.

For example, the controller 500 may identify that the full ice detection sensor 301 is malfunctioning in response to detection of full state of ice in the ice bucket 60 in the full ice detection process 2260 of the inspection cycle.

A total time required for the inspection cycle may be set to a time period during which the temperature of the storage compartments 21, 22, and 23 may sufficiently drop to a temperature sufficient to produce ice in a case where the refrigerator 1 is installed. To this end, in an embodiment, a time required for the ice making process 2220 of the inspection cycle may be longer than a time required for the ice making process 2220 of the ice making cycle.

In the disclosure, the inspection cycle may be performed regardless of the ice making mode set by a user. That is, in response to the temperature value measured by the temperature sensor 302 being greater than the preset value, the controller 500 may perform the inspection cycle regardless of the ice making mode set by the user.

According to the disclosure, in a case where the refrigerator 1 is installed for the first time, an ice making speed may be improved by performing the inspection cycle without supplying water to the ice trays 170 and 270.

The controller 500 may control the water supply device 50 to supply water to the ice trays 170 and 270 (1400) in response to completion of the inspection cycle, and may control the ice making device 200 to perform a default ice making cycle (1500).

The default ice making cycle refers to an ice making cycle corresponding to one ice making mode among a plurality of ice making modes that may be selected by a user.

As will be described later, the controller 500 may perform the default ice making cycle instead of performing a user-selected ice making cycle in response to completion of the inspection cycle.

Based on completion of the default ice making cycle, the controller 500 may perform the user-selected ice making cycle (1600) after supplying water.

Based on the user-selected ice making cycle being completed and a full state of ice not being detected in the ice bucket 60 (1700), the controller 500 may continuously supply water and then perform the user-selected ice making cycle (1600).

Hereinafter, a default ice making mode corresponding to the default ice making cycle and a plurality of ice making modes that a user may select will be described.

Figure 12:
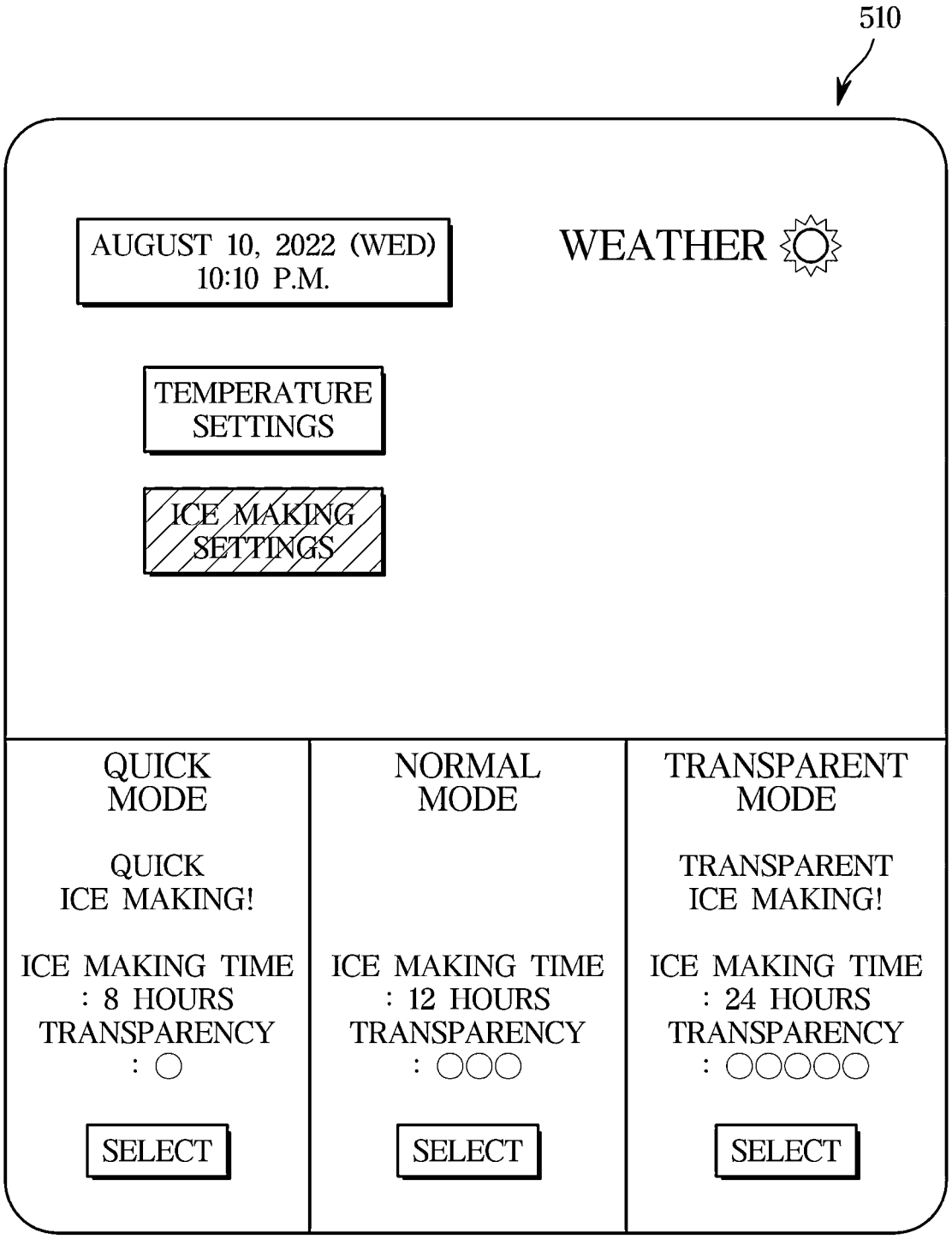
FIG. 12 illustrates an example of a user interface for selecting one of a plurality of ice making modes according to an embodiment.

FIG. 11 illustrates an example of a lookup table of a first heating process stage according to a plurality of ice making modes. FIG. 12 illustrates an example of a user interface for selecting one of a plurality of ice making modes.

Referring to FIG. 11, a plurality of ice making modes may include a first ice making mode, a second ice making mode, and/or a third ice making mode.

However, the number of the plurality of ice making modes is not limited thereto.

The memory 502 may store a lookup table corresponding to each of the plurality of ice making modes selectable by a user.

Each of the plurality of ice making modes may be classified according to an ice making speed and a transparency of ice. The ice making speed and the transparency of ice are inversely proportional to each other.

For example, the first ice making mode may refer to an ice making mode in which ice is produced at the fastest speed but the transparency of the ice is the least, and the third ice making mode may refer to an ice making mode in which ice is produced at the slowest speed but the transparency of the ice is the greatest. The second ice making mode may refer to an ice making mode in which an ice making speed of the second ice making mode is slower than the first ice making mode but faster than the third ice making mode, and a transparency of the ice is greater than the first ice making mode but less than the third ice making mode.

In each of the plurality of ice making modes, the first heating process is a process mainly related to the ice making speed and the transparency of ice.

The longer the heating devices 160 and 260 are turned on in the first heating process, the slower the ice making speed, but the transparency of ice is improved.

That is, the first heating processes of ice making cycles corresponding to each of the plurality of ice making modes are different.

For example, a total sum of operating times t11, t12, t13, t14, t15, t16, and t17 in the first ice making mode may be shorter than a total sum of operating times t21, t22, t23, t24, t25, t26, and t27 in the second ice making mode, and the total sum of the operating times t21, t22, t23, t24, t25, t26, and t27 in the second ice making mode may be shorter than a total sum of operating times t31, t32, t33, t34, t35, t36, and t37 in the third ice making mode.

For example, a time required for the first heating process of the ice making cycle corresponding to the first ice making mode may be approximately 4 hours, and a time required for the first heating process of the ice making cycle corresponding to the second ice making mode may be approximately 7 hours. Also, a time required for the first heating process of the ice making cycle corresponding to the third ice making mode may be approximately 19 hours.

In addition, a total sum of duty values d11, d12, d13, d14, d15, d16, and d17 in the first ice making mode may be less than a total sum of duty values d21, d22, d23, d24, d25, d26, and d27 in the second ice making mode, and the total sum of the duty values d21, d22, d23, d24, d25, d26, and d27 in the second ice making mode may be less than a total sum of duty values d31, d32, d33, d34, d35, d36, and d37 in the third ice making mode.

That is, a total sum of values obtained by multiplying the operating times t11, t12, t13, t14, t15, t16, and t17 by the duty values d11, d12, d13, d14, d15, d16, and d17, respectively, in the first ice making mode is less than a total sum of values obtained by multiplying the operating times t21, t22, t23, t24, t25, t26, and t27 by the duty values d21, d22, d23, d24, d25, d26, and d27, respectively, in the second ice making mode, and also is less than a total sum of values obtained by multiplying the operating times t31, t32, t33, t34, t35, t36, and t37 by the duty values d31, d32, d33, d34, d35, d36, and d37, respectively, in the third ice making mode.

To sum up, a total operating time during which the heating devices 160 and 260 operate in the ice making cycle corresponding to the first ice making mode may be shorter than a total operating time during which the heating devices 160 and 260 operate in the ice making cycle corresponding to the second ice making mode, and the total operating time during which the heating devices 160 and 260 operate in the ice making cycle corresponding to the second ice making mode may be shorter than a total operating time during which the heating devices 160 and 260 operate in the ice making cycle corresponding to the third ice making mode.

Referring to FIG. 12, a user may easily recognize characteristics of the first to third ice making modes through a user interface provided by the user interface 510, and may select any one of the first to third ice making modes.

The user interface 510 according to an embodiment may provide a visual indication indicating the characteristics of the first to third ice making modes, and a user interface element for selecting the first to third ice making modes.

For convenience of description, an ice making cycle corresponding to an ice making mode selected by a user is defined as a 'user-selected ice making cycle'.

In an embodiment, a default ice making mode may be an ice making mode that takes the shortest time to produce a piece of ice among the plurality of ice making modes that a user may select.

That is, in the above example, the default ice making mode may correspond to the first ice making mode.

The inspection cycle is performed (1300) based on the temperature value detected by the temperature sensor 302 being greater than the preset value, and then in a case where the default ice making cycle is not completed even though the temperature value detected by the temperature sensor 302 is less than the preset value after completion of the inspection cycle, the controller 500 may control the ice making device 200 to perform the default ice making cycle instead of the user-selected ice making cycle (1500).

That is, in response to the temperature value detected by the temperature sensor 302 being less than the preset value and the default ice making cycle being completed, the controller 500 may control the water supply device 50 to supply water to the ice trays 170 and 270, and control the ice making device 200 to perform the user-selected ice making cycle.

Accordingly, even though a user selects the second ice making mode or the third ice making mode after the refrigerator 1 is installed, the ice making cycle according to the first ice making mode is performed after the inspection cycle.

According to the disclosure, by performing the default ice making cycle whose ice making speed is the fastest after performing the inspection cycle, a user may be prevented from misperceiving a malfunction of the ice making device 200 due to delayed ice making.

In a case where the default ice making cycle is completed after performing the inspection cycle, the controller 500 may control the water supply device 50 and the ice making device 200 to perform the user-selected ice making cycle after supplying water.

In an embodiment, a total operating time of the heating devices 160 and 260 in the default ice making cycle may be longer than a total operating time of the heating devices 160 and 260 in the inspection cycle.

That is, the total operating time of the heating devices 160 and 260 in the default ice making cycle may be more than a first time period, and the total operating time of the heating devices 160 and 260 in the inspection cycle may be a second time period shorter than the first time period.

In addition, the total operating time of the heating devices 160 and 260 in the default ice making cycle may be shorter than a total operating time of the heating devices 160 and 260 in the ice making cycle according to the second ice making mode or third ice making mode.

In some embodiment, an initial operation timing of the heating devices 160 and 260 in the inspection cycle corresponds to the second heating process (2230), whereas an initial operation timing of the heating devices 160 and 260 in the default ice making cycle corresponds to the first heating process (2210).

That is, the initial operation timing of the heating devices 160 and 260 in the inspection cycle may precede an initial operation timing of the ice separator 300 by a first preset time, and an initial operation timing of the heating devices 160 and 260 in the default ice making cycle may precede the initial operation timing of the ice separator 300 by a second preset time. Here, the first preset time may be shorter than the second preset time.

The initial operation timing of the heating devices 160 and 260 in the inspection cycle is faster than the initial operation timing of the heating devices 160 and 260 in the default ice making mode which has the fastest ice making speed among the plurality of ice making modes selectable by a user. The total operating time of the heating devices 160 and 260 in the inspection cycle is shorter than the total operating time of the heating devices 160 and 260 in the default ice making mode which has the fastest ice making speed among the plurality of ice making modes.

According to the disclosure, an air temperature around the ice making device 200 may be quickly reduced by performing the inspection cycle in which the heating devices 160 and 260 do not operate or operate for a short time.

In addition, according to the disclosure, the air temperature around the ice making device 200 may be quickly reduced, and then the default ice making cycle may be performed regardless of an ice making mode selected by a user, and thus the first ice may be quickly produced.

According to various embodiments, the controller 500 may control the display 511 to output a visual indication notifying deterioration of ice quality based on the completion of the default ice making cycle.

Figure 13:
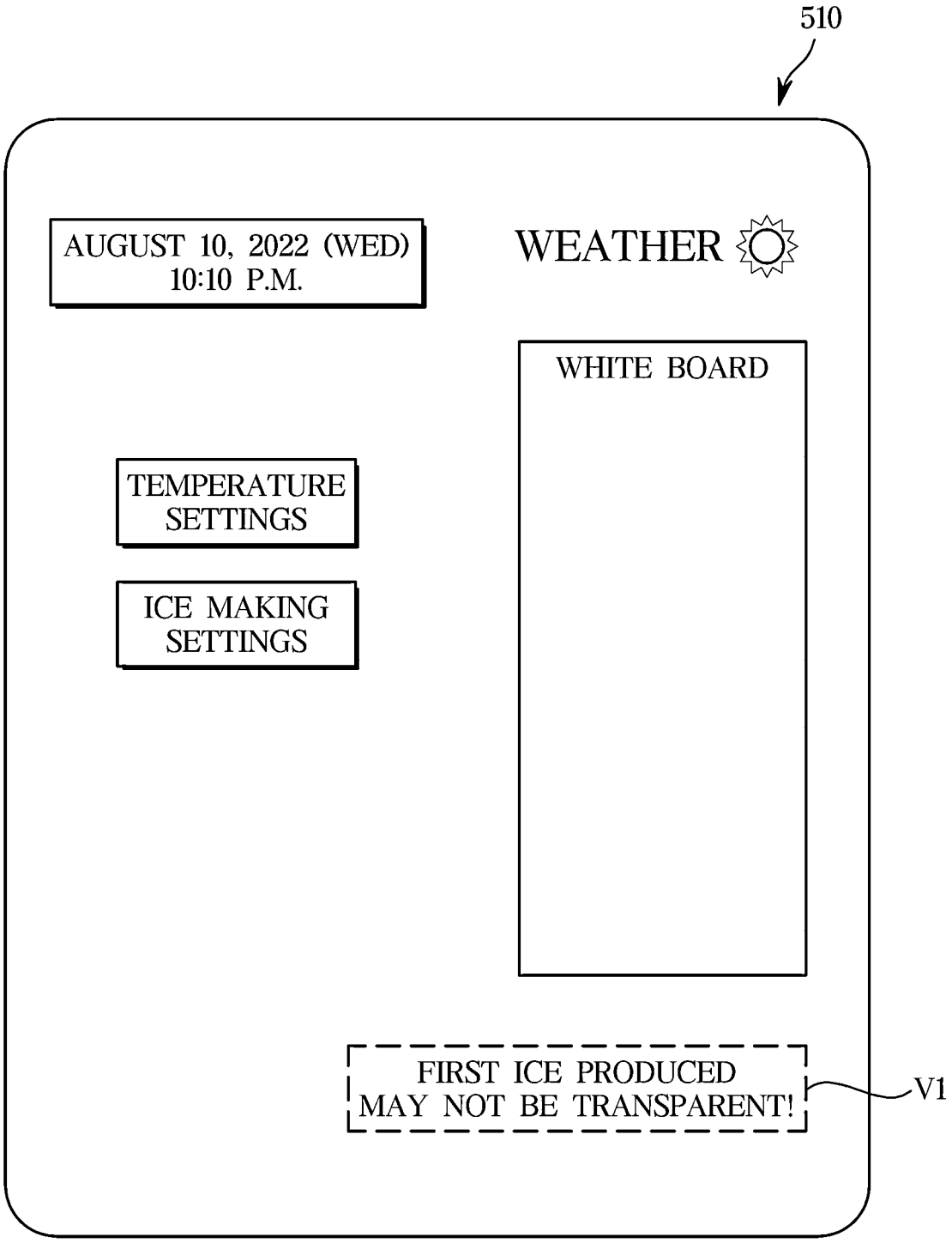
FIG. 13 illustrates an example of a visual indication for notifying deterioration of ice quality according to an embodiment.

FIG. 13 illustrates an example of a visual indication for notifying deterioration of ice quality.

Referring to FIG. 13, the user interface 510 (display 511) may output a visual indication V1 notifying deterioration of ice quality based on completion of a default ice making cycle.

According to the disclosure, even in a case where ice is produced by the default ice making cycle unrelated to an ice making cycle selected by a user, by making the user aware that a quality of the ice initially produced may be low, the user may be prevented from misperceiving a quality of the ice making device 200.

In addition, in response to a temperature value detected by the temperature sensor 302 being greater than a preset value, the controller 500 may control the display 511 to output a visual indication notifying a delay in ice production.

Figure 14:
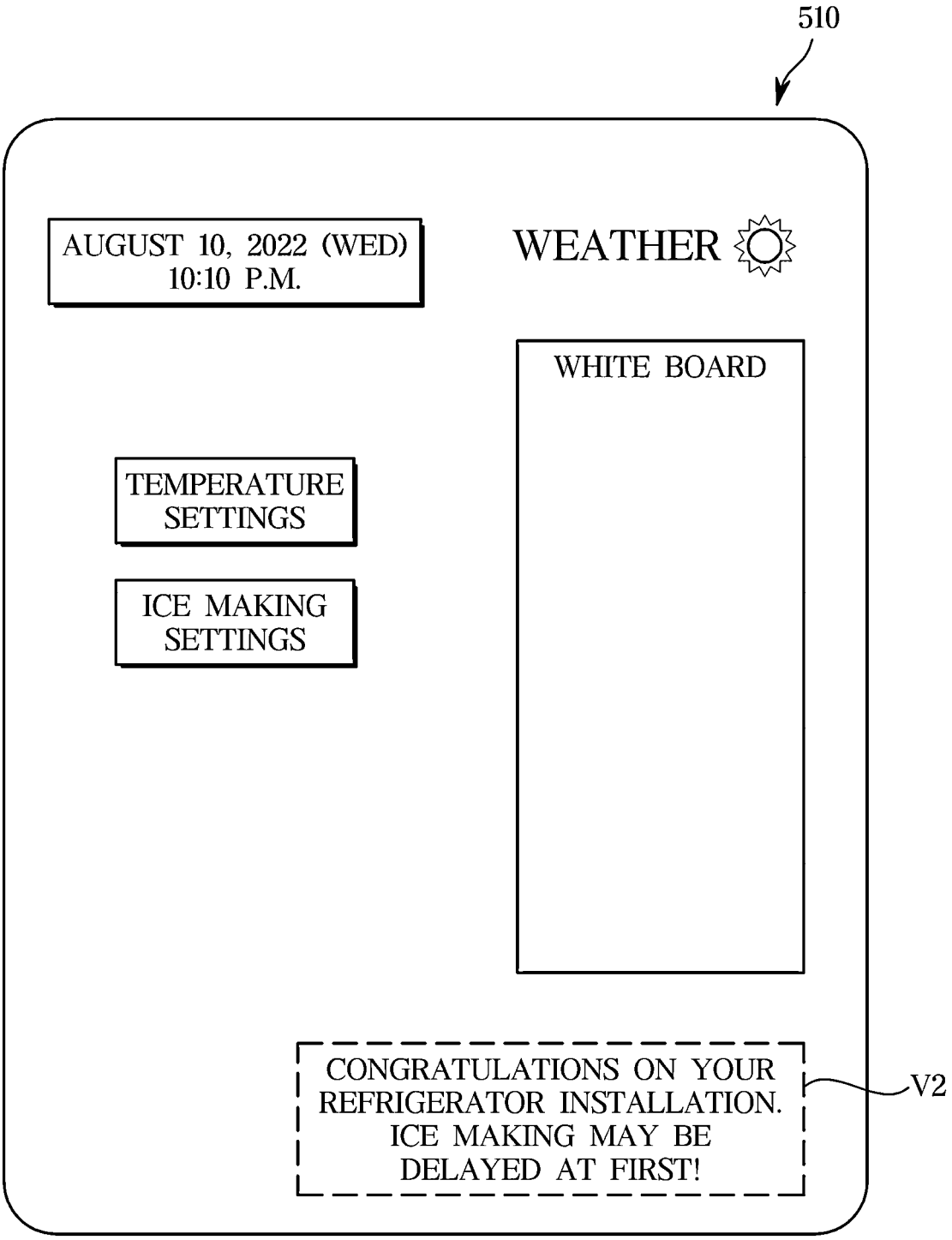
FIG. 14 illustrates an example of a visual indication for notifying a delay in ice making according to an embodiment.

FIG. 14 illustrates an example of a visual indication for notifying a delay in ice making.

Referring to FIG. 14, the user interface 510 (display 511) may output a visual indication V2 notifying a delay in ice production based on a temperature value detected by the temperature sensor 302 being greater than a preset value.

According to the disclosure, in a case where ice production may be delayed, such as in an initial installation condition of the refrigerator 1, by informing a user in advance that ice production will be delayed, the user may be prevented from misperceiving a quality of the ice making device 200.

Meanwhile, the visual indications V1 and V2 may be implemented in various forms.

For example, the visual indications V1 and V2 may inform a user in various forms such as text, shapes, characters, symbols, images, and the like.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that may be interpreted by a computer. For example, the computer-readable recording medium may be a Read Only Memory (ROM), a Random Access Memory (RAM), a magnetic tape, a magnetic disk, a flash memory, an optical data storage device, etc.

The computer-readable storage medium may be provided in the form of a non-transitory storage medium. Here, when a storage medium is referred to as "non-transitory," it may be understood that the storage medium is tangible and does not include a signal (e.g., an electromagnetic wave), but rather that data is semi-permanently or temporarily stored in the storage medium. For example, a "non-transitory storage medium" may include a buffer in which data is temporarily stored.

According to an embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed through an application store (e.g., Play Store™) online. In the case of online distribution, at least a portion of the computer program product may be stored at least semi-permanently or may be temporarily generated in a storage medium, such as a memory of a server of a manufacturer, a server of an application store, or a relay server.

Although embodiments of the disclosure have been described with reference to the accompanying drawings, those skilled in the art will appreciate that these inventive concepts may be embodied in different forms without departing from the scope and spirit of the disclosure, and should not be construed as limited to the embodiments set forth herein.

What is claimed is:

1. A refrigerator, comprising:

a main body comprising at least one storage compartment;

a temperature sensor arrangeable in the main body;

an ice making device comprising an ice tray arrangeable in the at least one storage compartment such that while the ice tray is arranged in the at least one storage compartment, the ice tray allows ice to be produced therein, and an ice separator configured to separate ice formed from the ice tray;

a cooling device configured to cool the at least one storage compartment;

a water supply device configured to supply water to the ice tray that produces the ice; and a controller configured to, based on a temperature value detected by the temperature sensor arranged in the main body being greater than a preset value, control the water supply device so that no water is supplied to the ice tray and control the ice making device to perform an inspection cycle to inspect the ice separator.

2. The refrigerator of claim 1, wherein the controller is configured to, based on completion of the inspection cycle, control the water supply device to supply water to the ice tray, and control the ice making device to perform a default ice making cycle to produce ice, and a default ice making mode corresponding to the default ice making cycle is an ice making mode that takes a shortest time to produce a piece of ice among a plurality of ice making modes selectable by a user.

3. The refrigerator of claim 2, wherein the ice making device further comprises:

a heating device configured to heat water stored in the ice tray, and wherein a total operating time of the heating device in the default ice making cycle is more than a first time period, and a total operating time of the heating device in the inspection cycle is a second time period shorter than the first time period.

4. The refrigerator of claim 3, wherein an initial operation timing of the heating device in the inspection cycle precedes an initial operation timing of the ice separator by a first preset time period, an initial operation timing of the heating device in the default ice making cycle precedes an initial operation timing of the ice separator by a second preset time period, and the first preset time period is shorter than the second preset time period.

5. The refrigerator of claim 1, wherein the ice making device further comprises:

a heating device configured to heat water stored in the ice tray, and wherein the controller is configured to operate the ice separator in the inspection cycle without operating the heating device.

6. The refrigerator of claim 2, wherein the controller is configured to, based on completion of the default ice making cycle, control the water supply device to supply water to the ice tray, and control the ice making device to perform a user-selected ice making cycle according to an ice making mode selected by the user from the plurality of ice making modes.

7. The refrigerator of claim 6, wherein the controller is configured to control the ice making device to perform the default ice making cycle instead of the user-selected ice making cycle, based on the default ice making cycle not being completed even though the temperature value detected by the temperature sensor is less than the preset value.

8. The refrigerator of claim 2, further comprising:

a display;

wherein the controller is configured to control the display to output a visual indication for notifying deterioration of ice quality based on completion of the default ice making cycle.

9. A method of controlling a refrigerator comprising:

controlling an ice making device including an ice tray that allows ice to be formed therein, and an ice separator configured to separate ice formed from the ice tray, and the refrigerator including a water supply device configured to supply water to the ice tray that forms the ice; and controlling, based on a temperature value detected by a temperature sensor arranged in a main body of the refrigerator being greater than a preset value, the water supply device not to supply water to the ice tray, and controlling the ice making device to perform an inspection cycle to inspect the ice separator.

10. The method of claim 9, further comprising:

based on completion of the inspection cycle, controlling the water supply device to supply water to the ice tray, and controlling the ice making device to perform a default ice making cycle to produce ice, wherein a default ice making mode corresponding to the default ice making cycle is an ice making mode that takes a shortest time to produce a piece of ice among a plurality of ice making modes selectable by a user.

11. The method of claim 10, wherein the ice making device further comprises:

a heating device configured to heat water stored in the ice tray, and wherein a total operating time of the heating device in the default ice making cycle is more than a first time period, and a total operating time of the heating device in the inspection cycle is a second time period shorter than the first time period.

12. The method of claim 11, wherein an initial operation timing of the heating device in the inspection cycle precedes an initial operation timing of the ice separator by a first preset time period, an initial operation timing of the heating device in the default ice making cycle precedes an initial operation timing of the ice separator by a second preset time period, and the first preset time period is shorter than the second preset time period.

13. The method of claim 11, wherein the controlling of the ice making device to perform the inspection cycle comprises operating the ice separator without operating the heating device.

14. The method of claim 10, further comprising:

based on completion of the default ice making cycle, controlling the water supply device to supply water to the ice tray, and controlling the ice making device to perform a user-selected ice making cycle according to an ice making mode selected by the user from the plurality of ice making modes.

15. The method of claim 14, wherein the controlling of the ice making device to perform the default ice making cycle comprises controlling the ice making device to perform the default ice making cycle instead of the user-selected ice making cycle, based on the default ice making cycle not being completed even though the temperature value detected by the temperature sensor is less than the preset value.

* * * * *